US009435143B2

(12) United States Patent
Shen

(10) Patent No.: US 9,435,143 B2
(45) Date of Patent: Sep. 6, 2016

(54) CYLINDRICAL LOCK WITH AUTOMATIC ELECTRONIC LOCKING FUNCTION

(71) Applicant: I-TEK METAL MFG. CO., LTD., Tainan (TW)

(72) Inventor: Chun-Meng Shen, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 338 days.

(21) Appl. No.: 14/266,874

(22) Filed: May 1, 2014

(65) Prior Publication Data

US 2015/0315818 A1 Nov. 5, 2015

(51) Int. Cl.

| | |
|---|---|
| ***E05B 1/00*** | (2006.01) |
| ***E05B 55/00*** | (2006.01) |
| ***E05B 47/00*** | (2006.01) |
| ***E05B 47/06*** | (2006.01) |
| *E05B 13/10* | (2006.01) |

(52) U.S. Cl.

CPC ..... *E05B 55/005* (2013.01); *E05B 47/00* (2013.01); *E05B 47/0012* (2013.01); *E05B 47/068* (2013.01); *E05B 2047/0031* (2013.01); *Y10T 292/1021* (2015.04)

(58) Field of Classification Search

CPC ..... E05B 47/00; E05B 51/00; E05B 51/02

USPC ..... 292/144, 347; 70/224

See application file for complete search history.

(56) References Cited

U.S. PATENT DOCUMENTS

| | | | | | |
|---|---|---|---|---|---|
| 4,465,311 | A * | 8/1984 | Austin | E05B 51/02 | 292/144 |
| 4,727,301 | A * | 2/1988 | Fulks | E05B 81/25 | 292/DIG. 23 |
| 5,129,273 | A * | 7/1992 | Fukui | F16H 25/2018 | 74/89.35 |
| 5,328,218 | A * | 7/1994 | Brusasco | E05B 81/25 | 292/201 |
| 5,526,710 | A * | 6/1996 | Ohta | E05B 81/25 | 292/144 |
| 5,628,216 | A * | 5/1997 | Qureshi | E05B 47/0012 | 292/201 |
| 5,669,843 | A * | 9/1997 | Bolton | F16H 19/00 | 475/149 |
| 6,119,538 | A * | 9/2000 | Chang | E05B 81/25 | 292/144 |
| 6,318,196 | B1 * | 11/2001 | Chang | E05B 81/25 | 292/144 |
| 6,363,763 | B1 * | 4/2002 | Geringer | E05B 45/12 | 70/432 |
| 6,619,085 | B1 * | 9/2003 | Hsieh | E05B 47/0012 | 292/144 |
| 6,705,138 | B1 * | 3/2004 | Shen | E05B 55/06 | 292/336.3 |
| 6,784,784 | B1 * | 8/2004 | Zehrung | E05B 17/22 | 116/17 |
| 6,802,194 | B1 * | 10/2004 | Shen | E05B 55/005 | 292/DIG. 27 |
| 7,543,469 | B1 * | 6/2009 | Tseng | E05B 47/026 | 292/142 |
| 8,051,689 | B1 | 11/2011 | Shen | 70/224 | |
| 8,356,499 | B2 * | 1/2013 | Peng | E05B 47/068 | 70/224 |
| 8,403,376 | B2 * | 3/2013 | Greiner | E05B 47/0012 | 292/144 |
| 8,690,205 | B2 * | 4/2014 | Benitez | E05B 17/22 | 292/347 |
| 2009/0025438 | A1 * | 1/2009 | Don | E05B 47/068 | 70/224 |
| 2012/0198897 | A1 * | 8/2012 | Lui | E05B 47/0012 | 70/280 |

* cited by examiner

*Primary Examiner* — Carlos Lugo

(74) *Attorney, Agent, or Firm* — Alan D. Kamrath; Kamrath IP Lawfirm, P.A.

(57) ABSTRACT

A cylindrical lock includes an outer operational device mounted to an outer side of a door, an inner operational device mounted to an inner side of a door, and a latch device between the inner and outer operational devices. The inner operational device includes an inner spindle and a locking driving device mounted in the inner spindle and connected to a burglarproof system. The locking driving device includes a motor for moving a driving member to perform a locking function setting or an unlocking function setting. Thus, the cylindrical lock in the locking state will not turn into the unlocking state even if power failure occurs. Likewise, the cylindrical lock in the unlocking state will not turn into the locking state even if power failure occurs.

4 Claims, 22 Drawing Sheets

CYLINDRICAL LOCK WITH AUTOMATIC ELECTRONIC LOCKING FUNCTION

BACKGROUND OF THE INVENTION

The present invention relates to a cylindrical lock with an automatic electronic locking function and, more particularly, to a cylindrical lock that can cooperate with a burglarproof system and a remote control device to proceed with locking/unlocking operation.

Currently available cylindrical locks capable of locking/unlocking by using electricity can be coupled to a burglarproof system for achieving the locking/unlocking function by controlling electrification or non-electrification of an electromagnetic actuator. Specifically, an electromagnetic force is created when the electromagnetic actuator is electrified, causing movement of a sliding rod connected to the electromagnetic actuator, which, in turn, causes movement of internal parts of the cylindrical lock to achieve the locking or unlocking function.

Responsive to different needs in different situations, the cylindrical locks can be set to be in the locking state or the unlocking state upon electrification or non-electrification. However, the cylindrical locks can not maintain the locking or unlocking state if electricity can not be supplied to the electromagnetic actuator due to failure of the power system.

Thus, a need exists for a cylindrical lock that can cooperate with a burglarproof system and a remote control device to reliably proceed with locking/unlocking operation even if power failure occurs.

BRIEF SUMMARY OF THE INVENTION

The present invention solves this need and other problems in the field of reliable operation of cylindrical locks with an automatic locking function by providing a cylindrical lock including an outer chassis having first and second portions spaced from each other along a longitudinal axis. The outer chassis further includes a first compartment in an end face of the first portion and an axial hole in communication with the first compartment of the outer chassis. The outer chassis is adapted to be mounted in a mounting space of a door.

An outer spindle is rotatably received in the axial hole of the outer chassis. The outer spindle includes first and second ends spaced from each other along the longitudinal axis. A passageway extends from the first end of the outer spindle towards but spaced from the second end of the outer spindle along the longitudinal axis. The first end of the outer spindle faces the first compartment of the outer chassis. The second end of the outer spindle is located outside of the outer chassis.

An actuating member has first and second ends spaced from each other along the longitudinal axis. The actuating member includes a space extending from the first end of the actuating member towards but spaced from the second end of the actuating member along the longitudinal axis. The actuating member further includes a limiting groove extending from an end face of the first end of the actuating member towards but spaced from the second end of the actuating member along the longitudinal axis and in communication with the space of the actuating member. The limiting groove of the actuating member includes larger and smaller groove sections in communication with each other. Each of the larger and smaller groove sections of the actuating member extends in a circumferential direction about the longitudinal axis. The actuating member further includes a lug spaced from the limiting groove of the actuating member in a radial direction perpendicular to the longitudinal axis. The actuating member is rotatably received in the outer spindle. The limiting groove of the actuating member is aligned with the passageway of the outer spindle. The lug is located outside of the outer spindle and is received in the first compartment of the outer chassis.

An outer handle is connected to the second end of the outer spindle. The outer handle and the outer spindle are jointly rotatable. A retractor is received in the first compartment of the outer chassis. The retractor is operatively coupled to the lug of the actuating member. The retractor is movable between third and fourth positions in a direction perpendicular to the longitudinal axis. A latch bolt is operatively connected to the retractor and is movable between a latching position outside of the door and an unlatching position inside the door.

An inner chassis is engaged with the outer chassis and faces the first compartment. The inner chassis includes an axial hole. The inner chassis is adapted to be mounted in the mounting space of the door.

An inner spindle is rotatably received in the axial hole of the inner chassis. The inner spindle includes first and second ends spaced from each other along the longitudinal axis. The inner spindle further includes a receiving hole extending from the first end of the inner spindle through the second end of the inner spindle. An engagement portion extends from the first end of the inner spindle away from the second end of the inner spindle along the longitudinal axis. The second end of the inner spindle is located outside of the inner chassis.

A pressing member is engaged with the engagement portion of the inner spindle. The pressing member and the inner spindle are jointly rotatable. The pressing member further includes an ear operably connected to the retractor. A motor is received in the receiving hole of the inner spindle. A gear reduction mechanism is mounted in the receiving hole of the inner spindle and is connected to the motor. The gear reduction mechanism includes a driving shaft driven by the motor.

A coupling shaft includes a connection end coupled to the driving shaft and a driving end spaced from the connection end along the longitudinal axis. The coupling shaft further includes an intermediate section between the connection end and the driving end. The driving end includes a threaded section formed on an outer periphery thereof.

A push ring has non-circular cross sections and includes a screw hole in threading connection with the threaded section of the coupling shaft. The push ring moves along the longitudinal axis when the coupling shaft rotates.

A sleeve is mounted around the push ring and the driving end of the coupling shaft. The sleeve is not jointly rotatable with the coupling shaft. The sleeve includes an inner end and an outer end spaced from the inner end along the longitudinal axis. The sleeve further includes a recessed portion extending from the inner end towards but spaced from the outer end of the sleeve. A receptacle extends from a bottom wall of the recessed portion towards but spaced from the outer end of the sleeve. The receptacle has non-circular cross sections. The push ring is non-rotatably received in the receptacle but is slideable in the receptacle along the longitudinal axis. The outer end of the sleeve extends into the space of the actuating member.

A bearing is mounted in the recessed portion of the sleeve and is pivotably coupled to the intermediate section. A first spring is received in the receptacle of the sleeve, is mounted between the sleeve and the coupling shaft in a radial direction perpendicular to the longitudinal axis, and is located between the push ring and the bearing along the longitudinal axis. A second spring identical to the first spring is received in the receptacle of the sleeve, is mounted between the sleeve and the coupling shaft in the radial direction perpendicular to the longitudinal axis, and is located between the push ring and a bottom wall of the receptacle along the longitudinal axis.

A driving member is pivotably mounted to the outer end of the sleeve. The driving member includes a leg received in the limiting groove of the actuating member and the passageway of the outer spindle. The driving member and the sleeve are jointly moveable along the longitudinal axis. The leg of the driving member is driven by and rotates together with the outer spindle when the outer spindle rotates. An inner handle is connected to the second end of the inner spindle.

When the inner handle is rotated, the inner spindle and the pressing member rotate jointly, and the latch bolt is moved from the latching position to the unlatching position.

When the driving member is in the first position, the leg of the driving member is located in the larger groove section of the actuating member. On the other hand, when the driving member is in the second position, the leg of the driving member is located in the smaller groove section of the actuating member.

When the driving member is in the first position and if the coupling shaft rotates in a first direction, the push ring is moved to push one of the first and second springs along the longitudinal axis to move the sleeve, which, in turn, moves the driving member from the first position to the second position along the longitudinal axis.

When the driving member is in the second position and if the coupling shaft rotates in a second direction reverse to the first direction, the push ring pushes the other of the first and second springs along the longitudinal axis to move the sleeve, which, in turn, moves the driving member from the second position to the first position.

When the driving member is in the first position and if the outer handle is rotated to pivot the driving member, the leg of the driving member pivots in the larger groove section of the actuating member, and the actuating member and the latch bolt are not moved.

When the driving member is in the second position and if the outer handle is rotated, the driving member and the actuating member are driven to rotate jointly, and the latch bolt moves from latching position to the unlatching position.

In an embodiment, the sleeve further includes a guiding groove formed in an inner periphery of the receptacle and extending from the bottom wall of the recessed portion to the bottom wall of the receptacle along the longitudinal axis. The push ring further includes a protrusion on an outer periphery thereof. The protrusion is slideably received in the guiding groove. The push ring is slideable relative to the sleeve along the longitudinal axis but is not rotatable relative to the sleeve.

In the embodiment, a limiting member is fixed to the outer end of the sleeve. The limiting member includes a shank and a head has an outer diameter larger than a diameter of the shank. The shank includes a distal end extending through the driving member and fixed to the outer end of the sleeve. A third spring is mounted around the shank of the limiting member and is located between the driving member and the head of the limiting member. The third spring biases the driving member to press against the outer end of the sleeve, creating a friction force between the driving member and the sleeve. The friction force is larger than a torque applied to the sleeve by the push ring during rotation of the coupling shaft, preventing the sleeve and the push ring from rotating jointly with the coupling shaft.

In the embodiment, the limiting member further includes an axial hole in an end face of the shank. A shaft coupling section extends from an end face of the driving end of the coupling shaft. The shaft coupling section is rotatably received in the axial hole of the limiting member and is slideable in the axial hole of the limiting member along the longitudinal axis, allowing the driving member and the limiting member to move jointly between the first and second positions along the longitudinal axis.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
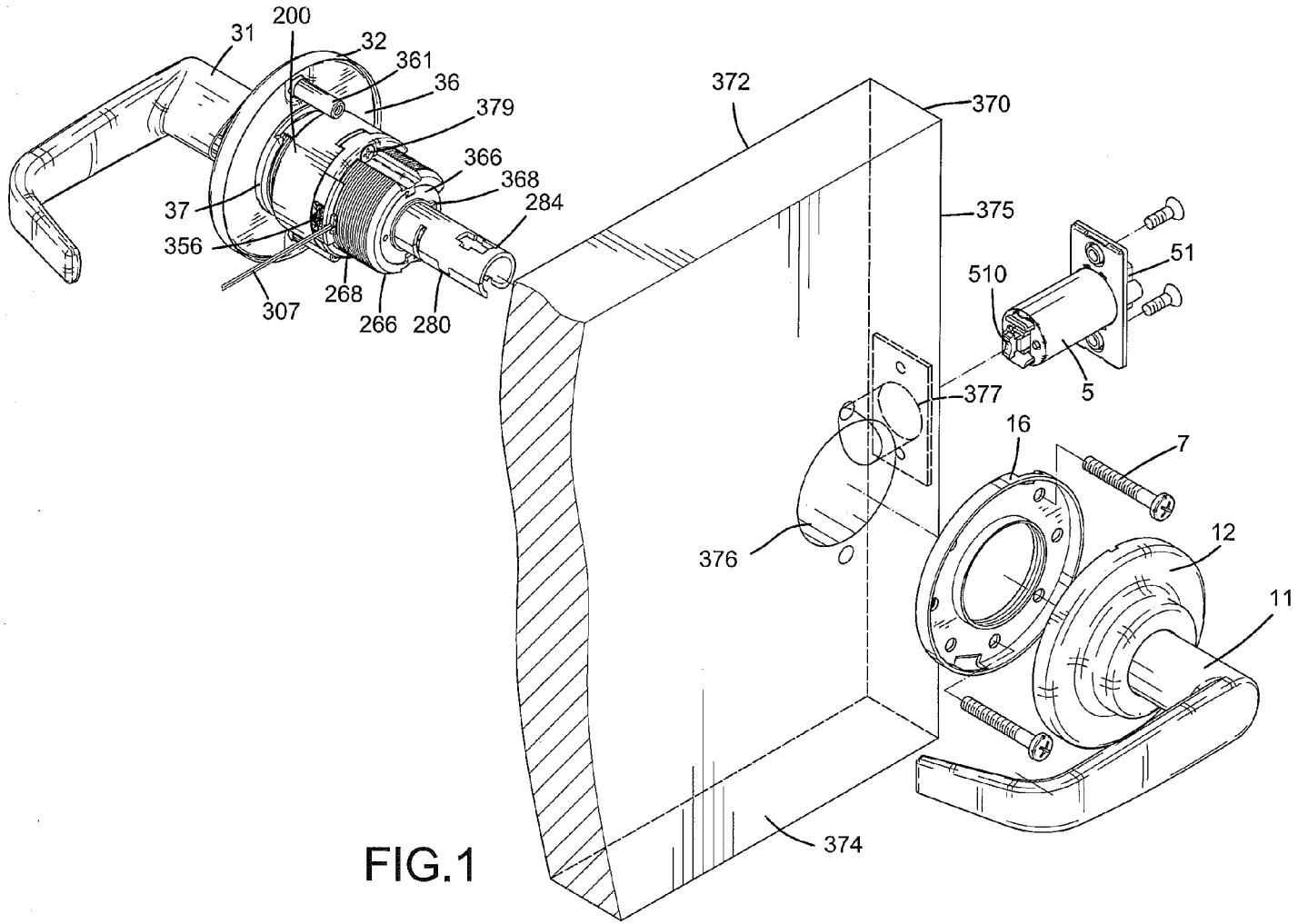
FIG. 1 is an exploded, perspective view of a portion of a door and a cylindrical lock of a first embodiment according to the present invention.
Figure 1A:
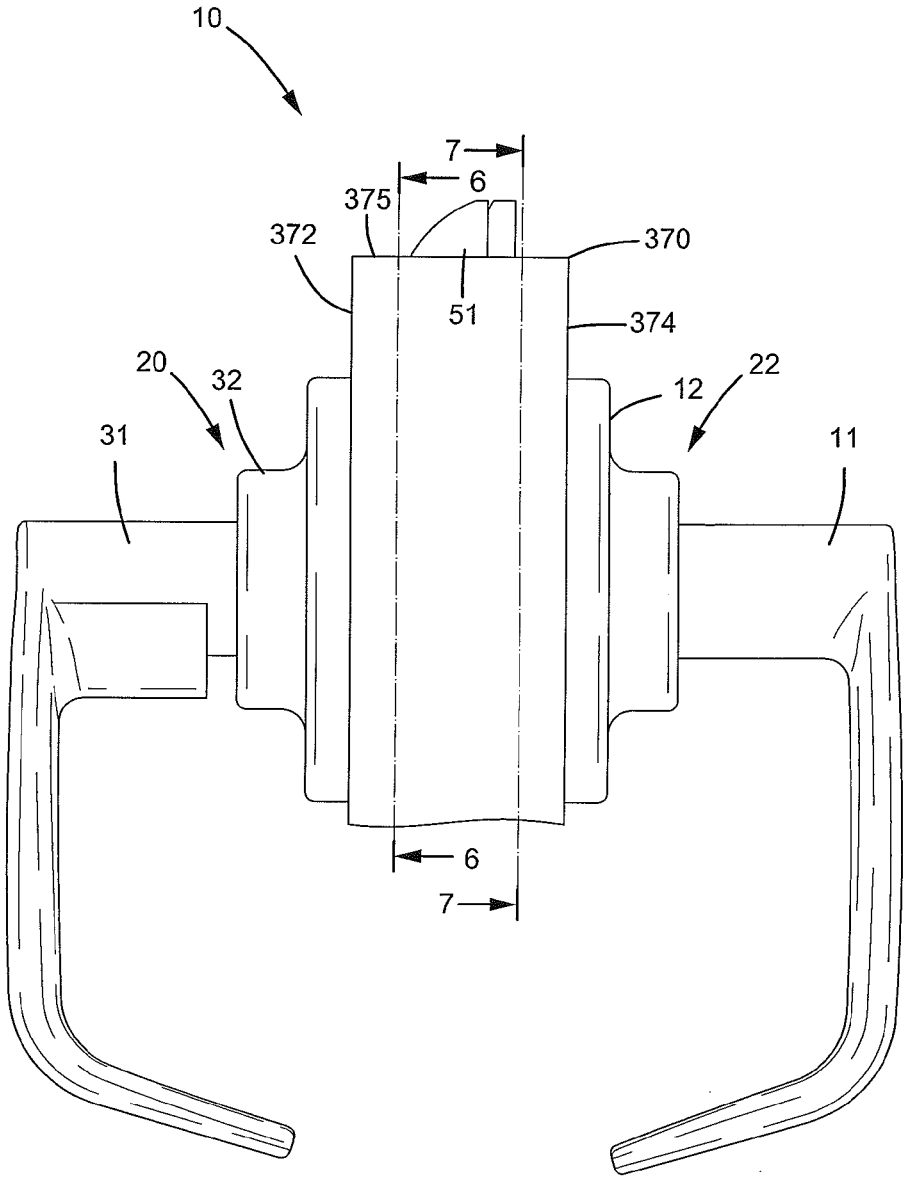
FIG. 1A is a top view of the door and the cylindrical lock of FIG. 1 after installation.
Figure 2:
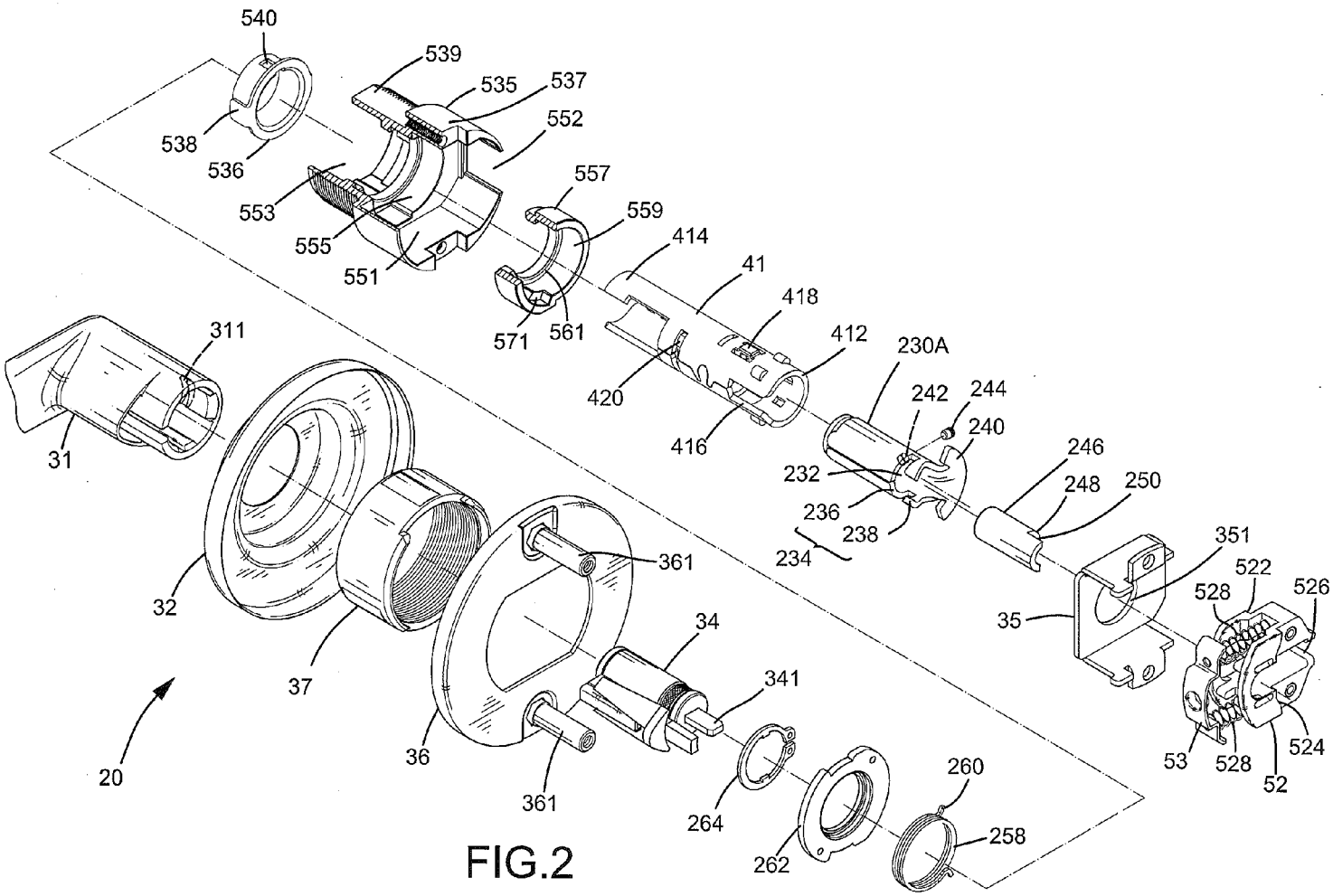
FIG. 2 is an exploded, perspective view of an outer operational device of the cylindrical lock of FIG. 1.
Figure 3:
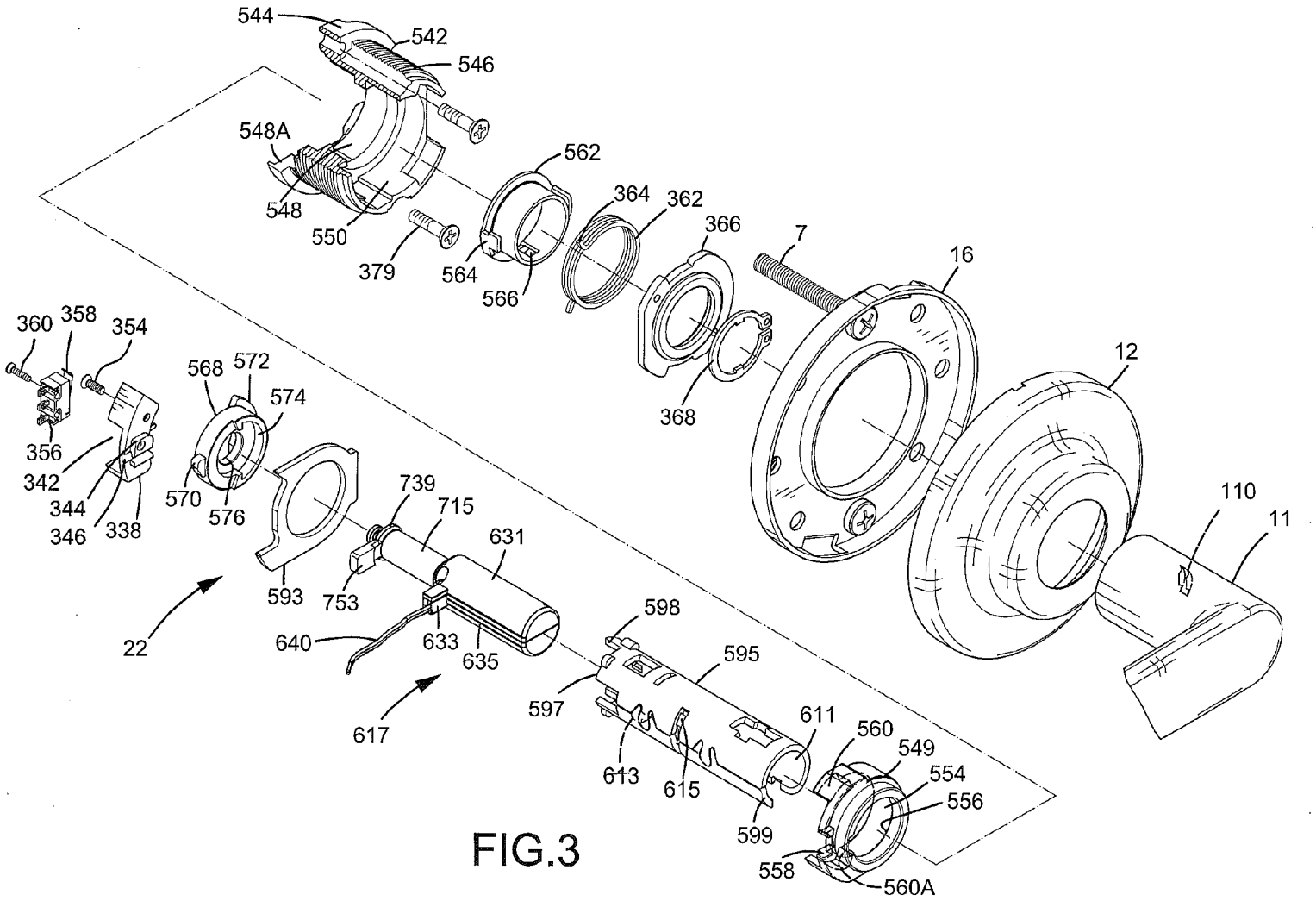
FIG. 3 is an exploded, perspective view of an inner operational device of the cylindrical lock of FIG. 1.
Figure 4:
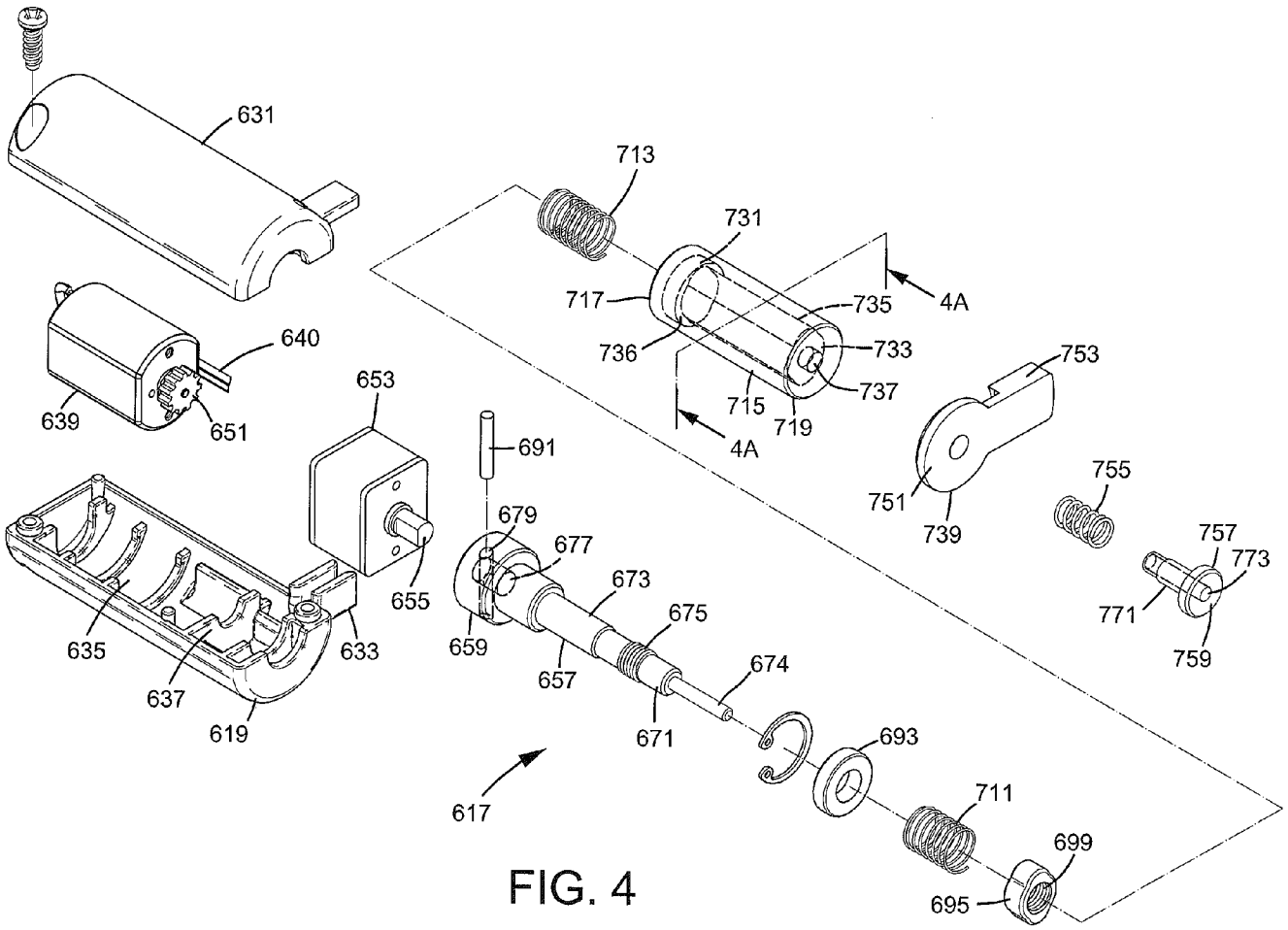
FIG. 4 is a partial, exploded, perspective view of the inner operational device of FIG. 3.
Figure 4A:
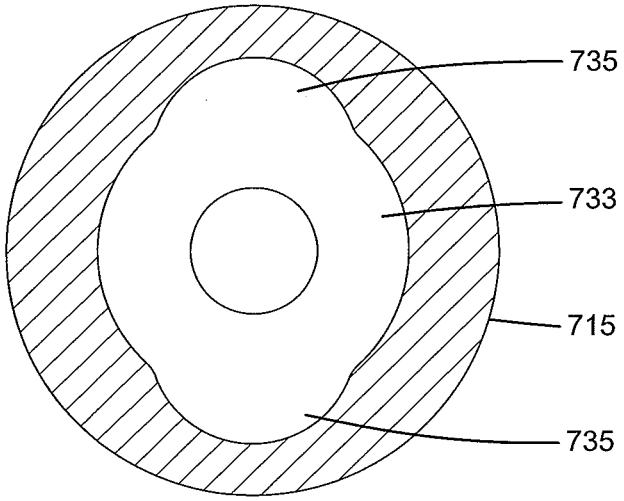
FIG. 4A is a cross sectional view taken along section line 4A-4A in FIG. 4.
Figure 5:
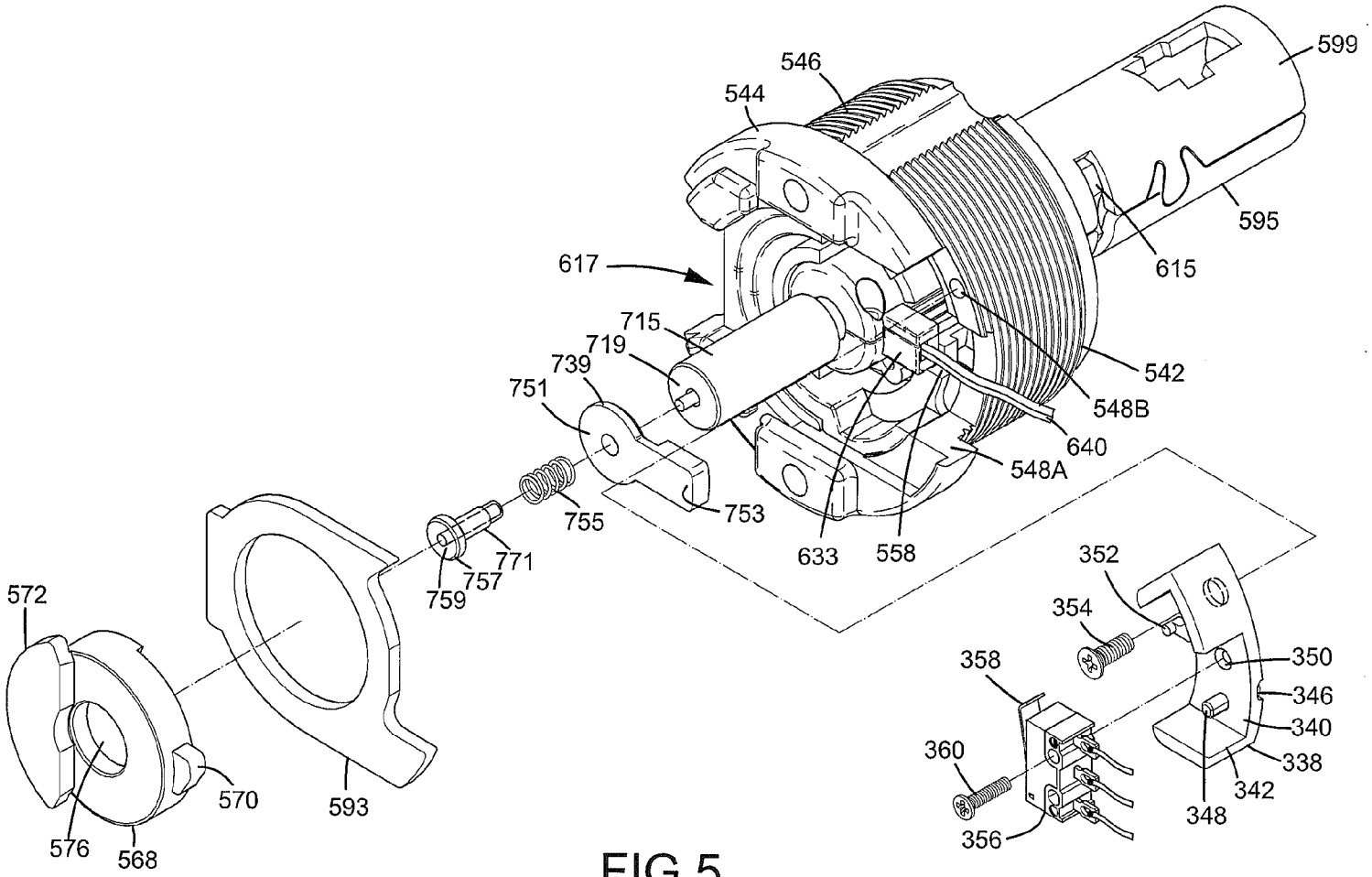
FIG. 5 is a partially exploded perspective view of a portion of the inner operational device of FIG. 3.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "inner", "outer", "side", "end", "portion", "section", "longitudinal", "radial", "circumferential", "lateral", "horizontal", "annular", "outward", "spacing", "length", "width", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A cylindrical lock 10 of a first embodiment according to the present invention is shown in the drawings and includes an outer chassis 535 having first and second portions 537 and 539 spaced along a longitudinal axis. Each of first and second portions 537 and 539 has an end face. A first compartment 551 extends along the longitudinal axis from the end face of first portion 537 towards but spaced from the end face of second portion 539. A notch 552 extends in a radial direction perpendicular to the longitudinal axis from an outer periphery of first portion 537 to first compartment 551. A second compartment 553 extends from the end face of second portion 539 towards but spaced from first portion 537. A third compartment 555 extends from a bottom face of first compartment 551 to second compartment 553 along the longitudinal axis. A lining sleeve 557 is securely mounted in third compartment 555 of outer chassis 535. Inner lining sleeve 557 includes a first end face facing and spaced from first compartment 551 along the longitudinal axis and a second end face. Lining sleeve 557 includes an axial hole 559 extending from the first end face of lining sleeve 557 through the second end face of lining sleeve 557. Axial hole 559 includes a larger hole section and a smaller hole section. A shoulder 561 is formed at in intersection between the larger hole section and the smaller hole section. Axial hole 559 is in communication with first compartment 551 and second compartment 553. A limiting groove 571 is formed in an inner periphery of axial hole 559, extends to the first end face of lining sleeve 557, and is substantially C-shaped in cross section.

According to the form shown, cylindrical lock 10 further includes an outer spindle 41 having first and second ends 412 and 414 spaced along the longitudinal axis. A plurality of protrusions is formed on an outer periphery of first end 412 of outer spindle 41. The protrusions are spaced from each other in a circumferential direction and form a stop portion. A passageway 416 extends from an end face of first end 412 towards but spaced from second end 414. Outer spindle 41 further includes a protrusion 418 extending from an outer periphery of first end 412. An outer engaging plate 420 is received in outer spindle 41 and is positioned by elasticity. An end of outer engaging plate 420 is located outside of outer spindle 41. Outer spindle 41 is rotatably mounted to outer chassis 535. Specifically, first end 412 of outer spindle 41 is received in axial hole 559 of lining sleeve 557. The outer periphery of first end 412 of outer spindle 41 rotatably abuts the inner periphery of axial hole 559 of lining sleeve 557. The stop portion at first end 412 of outer spindle 41 rotatably abuts shoulder 561 of axial hole 559. Passageway 416 of outer spindle 41 is aligned with limiting groove 571. Second end 414 of outer spindle 41 is located outside of outer chassis 535. Protrusion 418 of outer spindle 41 is received in second compartment 553.

According to the form shown, cylindrical lock 10 further includes an outer spring 258, an outer cover 262, an outer follower ring 536, and an outer retainer ring 264. Outer follower ring 536 is mounted around outer spindle 41 and is received in second compartment 553. Outer follower ring 536 includes an actuating arm 538 on an outer periphery thereof and an engagement groove 540 in the outer periphery thereof. Engagement groove 540 engages with protrusion 418 of outer spindle 41. Outer spring 258 is in the form of a torsion spring having two tangs 260. Outer spring 258 is mounted around outer follower ring 536 and is located in second compartment 553, with tangs 260 located on opposite sides of actuating arm 538 of outer follower ring 536 and with tangs 260 engaged with the inner periphery of second compartment 553, such that one of tangs 260 is pivoted by actuating arm 538 and the other tang 260 is not moved when outer spindle 41 is rotated to pivot outer follower ring 536, providing elasticity for returning outer spindle 41. Outer cover 262 is mounted around outer spindle 41 and closes an end opening of second compartment 553, preventing outer spring 258 from disengaging from second compartment 553. Outer retainer ring 264 is mounted to the outer periphery of outer spindle 41 and is located outside of outer chassis 535. Outer retainer ring 264 abuts an outer face of outer cover 262. Furthermore, first end 412 of outer spindle 41 abuts shoulder 561 of lining sleeve 557. Thus, outer spindle 41 can not move relative to outer chassis 535 along the longitudinal axis.

According to the form shown, cylindrical lock 10 further includes an actuating member 230A rotatably received in outer spindle 41. A space 232 extends from a first end of actuating member 230A along the longitudinal axis towards but spaced from a second end of actuating member 230A. A limiting groove 234 extends from an end face of the first end of actuating member 230A towards but spaced from the second end of actuating member 230A along the longitudinal axis and is in communication with space 232. Limiting groove 234 has larger and smaller groove sections 236 and 238 extending in a circumferential direction about the longitudinal axis. Larger and smaller groove sections 236 and 238 are in communication with each other. An arc of larger groove section 236 in the circumferential direction is larger than that of smaller groove section 238. Actuating member 230A further includes a sector-shaped lug 240 extending outward from the first end of actuating member 230A and extending in the circumferential direction. In the form shown, smaller groove section 238 extends from an end face of the first end of actuating member 230A to larger groove section 236 along the longitudinal axis and is located between larger groove section 236 and lug 240. Furthermore, an engaging hole 242 extends from an outer periphery of actuating member 230A in a radial direction perpendicular to the longitudinal axis through space 232. A follower pin 244 is securely received in engaging hole 242 and has an end located in space 232. Limiting groove 234 of actuating member 230A is aligned with passageway 416 of outer spindle 41. Lug 240 is located outside of outer spindle 41 and is received in first compartment 551 of outer chassis 535.

According to the form shown, cylindrical lock 10 further includes a follower 246 having a recessed portion 248 in an end thereof. Recessed portion 248 includes two abutment walls 250. Follower 246 is rotatably received in space 232 of actuating member 230A with recessed portion 248 aligned with follower pin 244 and with follower pin 244 located between abutment walls 250.

Figure 6:
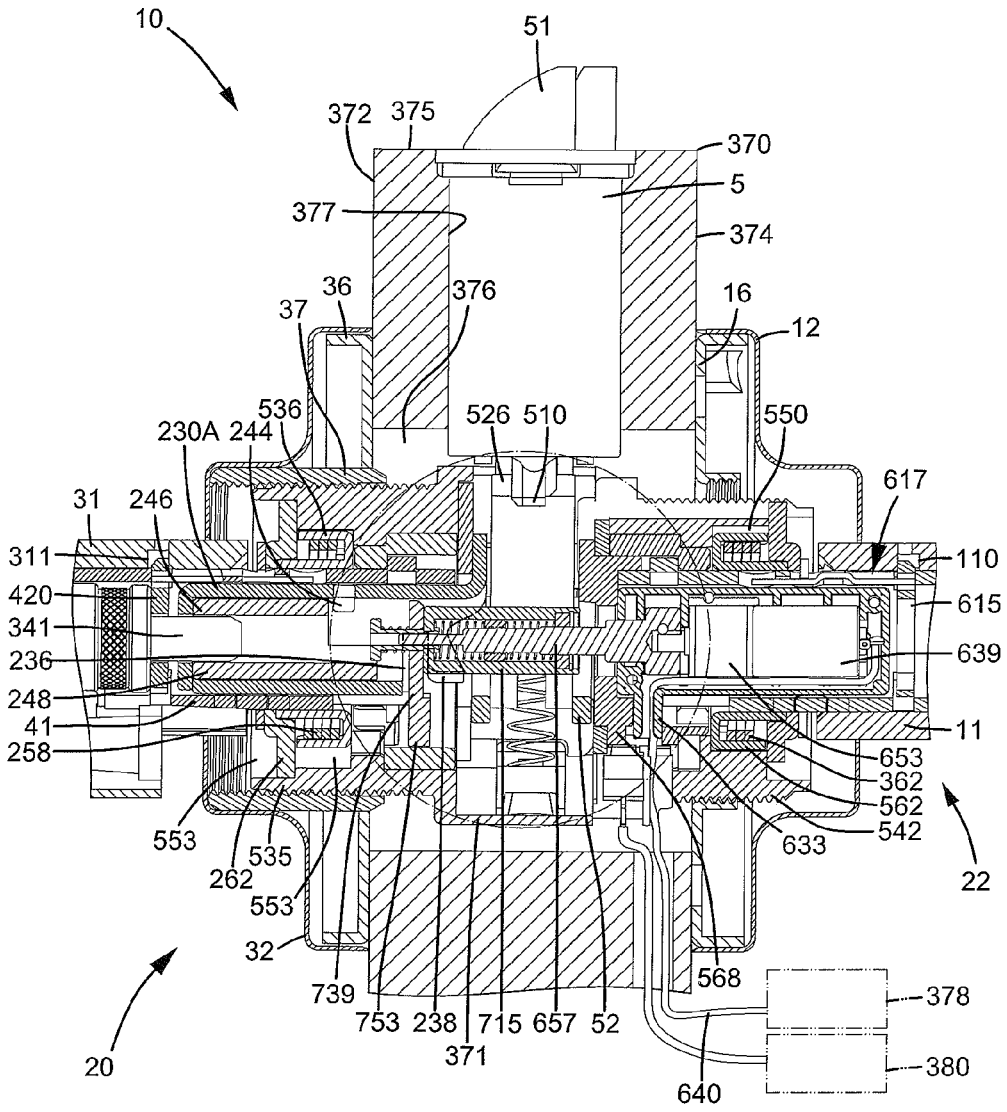
FIG. 6 is a cross sectional view taken along section line 6-6 in FIG. 1A.
Figure 6A:
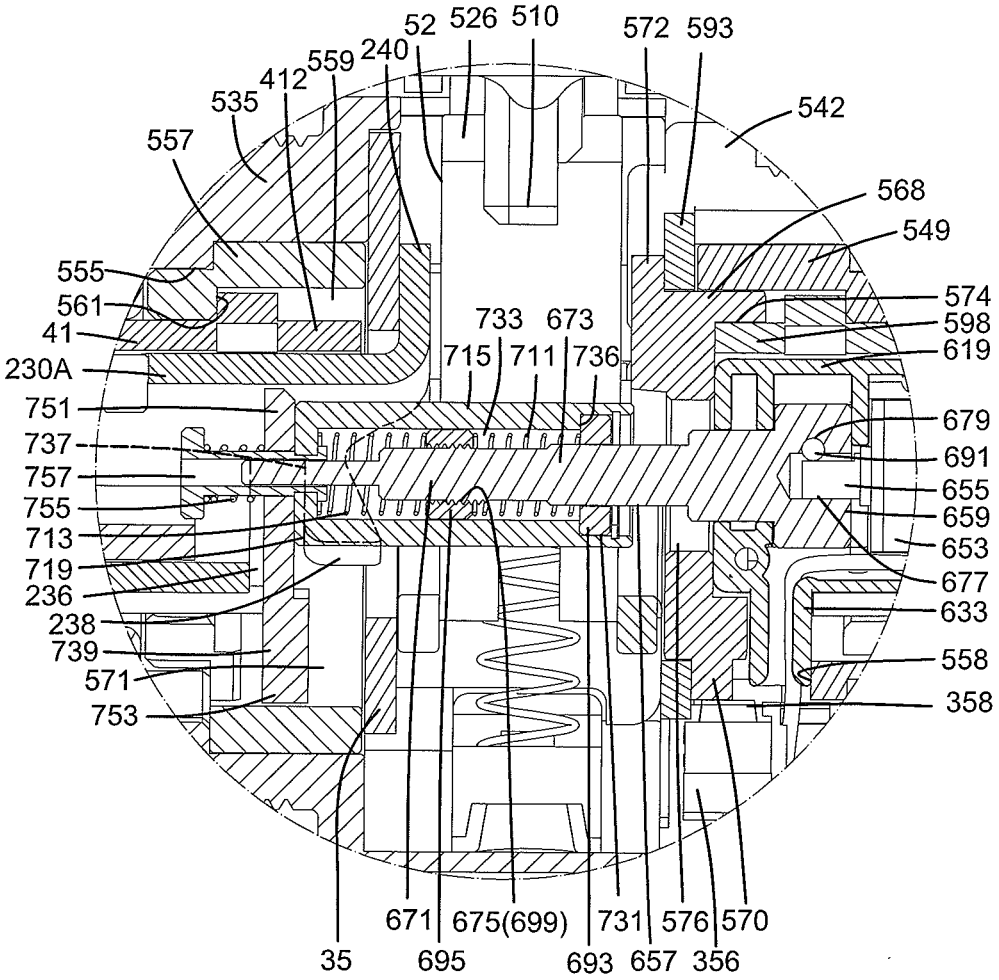
FIG. 6A is an enlarged view of a circled portion of FIG. 6.

According to the form shown, cylindrical lock 10 further includes a partitioning plate 35, a retractor 52, a positioning plate 53, and two springs 528. Partitioning plate 35 has two sides spaced along the longitudinal axis and a through-hole 351 extending from a side through the other side of partitioning plate 35. Retractor 52 has first and second actuation walls 522 and 524 spaced along the longitudinal axis and a connecting end 526 between first and second actuation walls 522 and 524. Partitioning plate 35 is received in first compartment 551, with a side of partitioning plate 35 abutting an end wall of first compartment 551 and with through-hole 351 aligned with axial hole 559 of lining sleeve 557. Retractor 52 is movably received in first compartment 551 of outer chassis 535. First actuation wall 522 faces partitioning plate 35. Connecting end 526 of retractor 52 is aligned with notch 552 of outer chassis 535. Springs 528 are mounted between positioning plate 53 and retractor 52. Specifically, each spring 528 has an end fixed to positioning plate 53. The other end of each spring 528 abuts against retractor 52. Lug 240 of actuating member 230A engages with first actuation wall 522 of retractor 52. Retractor 52 is movable in a direction perpendicular to the longitudinal axis between a third position (FIG. 6) close to notch 552 and a fourth position (FIG. 11) away from notch 552. Springs 528 bias retractor 52 from the fourth position to the third position.

According to the form shown, cylindrical lock 10 further includes an inner chassis 542 engaged with outer chassis 535. Inner chassis 542 includes first and second ends spaced along the longitudinal axis and respectively having an engaging portion 546 and a flange 544 spaced from engaging portion 546 along the longitudinal axis. A first chamber 548 extends from an end face of the first end of inner chassis 542 towards but spaced from the second end of inner chassis 542. A second chamber 550 extends from an end face of the second end of inner chassis 542 to first chamber 548. A sector-shaped insertion groove 548A is formed in a surface of flange 544 facing outer chassis 535. Insertion groove 548A has a screw hole 548B in a bottom face thereof. A lining sleeve 549 is securely mounted in first chamber 548 of inner chassis 542. Lining sleeve 549 includes an axial hole 554 extending from an end of lining sleeve 549 through the other end of lining sleeve 549. Axial hole 554 includes a smaller hole section and a larger hole section. A shoulder 556 is formed at an intersection between the smaller section and the larger section of axial hole 554. A restraining groove 560 is defined in an inner periphery of the larger hole section of axial hole 554. Restraining groove 560 includes two restraining walls 560A spaced from each other in a circumferential direction about a longitudinal axis of axial hole 554. A fixing groove 558 is defined in a bottom wall of restraining groove 560 and is in communication with the larger hole section of axial hole 554. Furthermore, a pressing plate 593 is mounted in inner chassis 542 and is located adjacent to an opening of first chamber 548 to cover first chamber 548.

According to the form shown, cylindrical lock 10 further includes an inner spindle 595 rotatably received in axial hole 554 of inner sleeve 549. Inner spindle 595 includes first and second ends 597 and 599 spaced from each other along the longitudinal axis. An engagement portion 598 extends from first end 597 of inner spindle 595 along the longitudinal axis. A plurality of protrusions is formed on an outer periphery of first end 597 of inner spindle 595 and forms a stop portion. A receiving hole 611 extends from first end 597 through second end 599 of inner spindle 595 along the longitudinal axis. A protrusion 613 is formed on an outer periphery of inner spindle 595, extends in the circumferential direction about the longitudinal axis, and is located adjacent to first end 597 of inner chassis 542. An inner engaging plate 615 is received in inner spindle 595 and positioned by elasticity. An end of inner engaging plate 615 is located outside of inner spindle 595. First end 597 of inner spindle 595 is received in axial hole 554 of lining sleeve 549. The stop portion on first end 597 of inner spindle 595 abuts shoulder 556 of lining sleeve 549. Protrusion 613 of inner spindle 595 is located in second chamber 550 of inner chassis 542. Second end 599 of inner spindle 595 is outside of inner chassis 542.

According to the form shown, cylindrical lock 10 further includes an inner spring 362, an inner cover 366, an inner follower ring 562, and an inner retainer ring 368. Inner follower ring 562 is mounted around inner spindle 595 and is located in second chamber 550 of inner chassis 542. Inner follower ring 562 includes an actuating arm 564 on an outer periphery thereof and an engagement groove 566 in the outer periphery thereof. Protrusion 613 of inner spindle 595 is engaged in engagement groove 566. Inner spring 362 is in the form of a torsion spring and has two tangs 364. Inner spring 362 is mounted around inner follower ring 562 and is located in second chamber 550 of inner chassis 542. Tangs 364 of inner spring 362 are attached to actuating arm 564 of inner follower ring 562. Furthermore, each tang 364 of inner spring 362 engages with the inner periphery of second chamber 550 of inner chassis 542, such that one of tangs 364 is pivoted by actuating arm 564 and the other tang 364 is not moved when inner spindle 595 is rotated to pivot inner follower ring 562, providing elasticity for returning inner spindle 595. Inner cover 366 is mounted around inner spindle 595 and closes an end opening of second chamber 550 of inner chassis 542, preventing inner spring 362 from disengaging from second chamber 550. Inner retainer ring 368 is mounted to the outer periphery of inner spindle 595 and is located outside of inner chassis 542. Inner retainer ring 368 abuts an outer face of inner cover 366. Thus, inner spindle 595 can not move relative to inner chassis 542 along the longitudinal axis.

According to the form shown, cylindrical lock 10 further includes a locking driving device 617 mounted in receiving hole 611 of inner spindle 595. Locking driving device 617 includes a first housing 619 and a second housing 631 detachably mounted to first housing 619. First and second housing 619 and 631 together form a housing and together define a first receiving space 635 and a second receiving space 637. An arm 633 extends from an outer periphery of the housing in a radial direction perpendicular to the longitudinal axis. The housing is received in receiving hole 611 of inner spindle 595 with arm 633 engaged in fixing groove 558 of lining sleeve 549. Thus, first and second housings 619 and 631 do not rotate when inner spindle 595 rotates.

Locking driving device 617 further includes a motor 639 mounted in first receiving space 635. A gear 651 is mounted on an output shaft of motor 639. A wire 640 is connected to the motor 639 and extends through arm 633 out of first and second housings 619 and 631. Locking driving device 617 further includes a speed reduction mechanism 653 received in second receiving space 637 and meshed with gear 651. Thus, when motor 639 operates, a driving shaft 655 of speed reduction mechanism 653 is driven at a lower speed via transmission by speed reduction mechanism 653.

According to the form shown, locking driving device 617 further includes a coupling shaft 657 having a connection end 659, a driving end 671 spaced from connection end 659 along the longitudinal axis, and an intermediate section 673 between connection end 659 and driving end 671. A shaft coupling section 674 extends from an end face of driving end 671 along the longitudinal axis. A coupling hole 677 extends from connection end 659 towards but spaced from intermediate section 673. A pin hole 679 extends through connection end 659 in a diametric direction perpendicular to the longitudinal axis. A threaded section 675 is formed an on outer periphery of driving end 671. Coupling hole 677 of coupling shaft 657 engages with driving shaft 655 of speed reduction mechanism 653. A pin 691 extends through pin hole 679. Thus, coupling shaft 657 and driving shaft 655 can rotate jointly about the longitudinal axis.

According to the form shown, locking driving device 617 further includes a sleeve 715, a bearing 693, and a push ring 695. Sleeve 715 includes an inner end 717 and an outer end 719 spaced along the longitudinal axis. A recessed portion 731 extends from inner end 717 towards but spaced from outer end 719 along the longitudinal axis. A receptacle 733 extends from a bottom wall of recessed portion 731 towards but spaced from outer end 719 along the longitudinal axis. Two guiding grooves 735 are formed in an inner periphery of receptacle 733 and extend from the bottom wall of the recessed portion 731 to the bottom wall of the receptacle 733 along the longitudinal axis such that receptacle 733 has non-circular cross sections. A shoulder 736 is formed at an intersection between recessed portion 731 and receptacle 733. Furthermore, a through-hole 737 extends from outer end 719 of sleeve 715 to receptacle 733 along the longitudinal axis. Push ring 695 includes two protrusions on an outer periphery thereof and has cross sections identical to the cross sections of receptacle 733 of sleeve 715. Push ring 695 further includes a screw hole 699 in a center thereof. Push ring 695 is slideably received in receptacle 733 of sleeve 715. Bearing 693 is mounted in recessed portion 731 of and abuts shoulder 736. Driving end 671 of coupling shaft 657 extends through receptacle 733 of sleeve 715. Intermediate section 673 of coupling shaft 657 is pivotably coupled to bearing 693. Threaded section 675 is in threading connection with screw hole 699 of push ring 695. Furthermore, a retainer ring is mounted around coupling shaft 657 and abuts bearing 693 to prevent bearing 693 from disengaging from sleeve 715 along the longitudinal axis.

According to the form shown, a first spring 711 is mounted between an inner periphery of receptacle 733 of sleeve 715 and coupling shaft 657 in a radial direction and is attached between bearing 693 and push ring 695 along the longitudinal axis. A second spring 713 is mounted between the inner periphery of receptacle 733 of sleeve 715 and coupling shaft 657 in the radial direction and is attached between bearing 693 and a bottom wall of receptacle 733 along the longitudinal axis. First ands second springs 711 and 713 can be identical. Specifically, first and second springs 711 and 713 can have the same elastic coefficient and have the same length along the longitudinal axis. Thus, the push ring 695 is substantially at a center of receptacle 733 of sleeve 715 in a natural state.

According to the form shown, locking driving device 617 further includes a driving member 739, a limiting member 757, and a third spring 755. Driving member 739 includes a pivotal portion 751 and a leg 753 extending from pivotal portion 751 in a radial direction perpendicular to the longitudinal axis. Limiting member 757 includes a head 759 and a shank 771 having a diameter smaller than a diameter of head 759. An axial hole 773 extends from head 759 through a distal end of shank 771. Driving member 739 is mounted around outer end 719 of sleeve 715 with pivotal portion 751 aligned with through-hole 737. Shank 771 of limiting member 757 extends through pivotal portion 751 of driving member 739 and is fixed in through-hole 737 of sleeve 715. Furthermore, shaft coupling section 674 of coupling shaft 657 is rotatably received in axial hole 773 and is slideable in axial hole 773 along the longitudinal axis. Thus, driving member 739 can rotate about shank 771 relative to limiting member 757 and sleeve 715. Third spring 755 is mounted around shank 771 of limiting member 757 and is attached between pivotal portion 751 of limiting member 757 and head 759 of limiting member 757, providing friction between pivotal portion 751 of driving member 739 and the end face of outer end 719 of sleeve 715. Sleeve 715 is supported by bearing 693 and shaft coupling section 674 of coupling shaft 657, such that the longitudinal axis of sleeve 715 is coincident to the longitudinal axis of coupling shaft 657, assuring threaded section 675 to be in threading connection with screw hole 699 of push ring 695 when coupling shaft 657 rotates.

According to the form shown, cylindrical lock 10 further includes a pressing member 568 received in first chamber 548 of inner chassis 542. Pressing member 568 includes a pressing block 570 extending radially from an outer periphery of pressing member 568 in a radial direction perpendicular to the longitudinal axis. A through-hole 576 extends from a first side of pressing member 568 through a second side of pressing member 568 along the longitudinal axis. An engagement groove 574 is defined in the first side of pressing member 568 and is in communication with through-hole 576. An ear 572 is formed on the second side of pressing member 568 and extends outward in a radial direction perpendicular to the longitudinal axis. Engagement portion 598 of inner spindle 595 engages with engagement groove 574 of pressing member 568. Pressing member 568 and inner spindle 595 can jointly rotate about the longitudinal axis. Furthermore, pressing block 570 of pressing member 568 is received in restraining groove 560 of lining sleeve 549. Ear 572 of pressing member 568 is on an outer side of first chamber 548 of inner chassis 542 along the longitudinal axis and is coupled to second actuation wall 524 of retractor 52. Coupling shaft 657 extends through through-hole 576.

According to the form shown, cylindrical lock 10 further includes a seat 338 mounted in insertion groove 548A of inner chassis 542. Seat 338 includes a fixing wall 340 having first and second faces spaced along the longitudinal axis. A hole 350 extends from the first face through the second face of fixing wall 340. A coupling portion 344 is formed on the first face of fixing wall 340. Coupling portion 344 includes first and second lateral surfaces spaced along an axis perpendicular to the longitudinal axis. A wire groove 346 extends from the first lateral surface through the second lateral surface of coupling portion 344. Seat 338 further includes a positioning peg 348 formed on the second face of fixing wall 340. Furthermore, a restraining peg 352 is formed on a lateral side of seat 338. Further, a notch 342 is formed in the other lateral side of seat 338 and is located adjacent to positioning peg 348. Seat 338 is received in insertion groove 548A of inner chassis 542. A fastener 354 extends through fixing wall 340 into screw hole 548B of inner chassis 542 to fix seat 338 in insertion groove 548A of inner chassis 542. Wire 640 of locking driving device 617 is retained in wire groove 346 of coupling portion 344, preventing wire 640 from being damaged due to twisting.

According to the form shown, cylindrical lock 10 further includes a detection member 356 such as a micro switch. Detection member 356 is mounted on seat 338 and includes a pressable pressing plate 358. Specifically, detection member 356 is fixed to fixing wall 340 of seat 338 with positioning peg 348 extending into a hole in detection member 356. A fastener 360 extends through detection member 356 into hole 350 of seat 338. Thus, detection member 356 is securely fixed to seat 338 with pressing plate 358 aligned with and pressed against by pressing block 570 of pressing member 568. Detection member 356 is electrically connected to a burglarproof system 380.

According to the form shown, cylindrical lock 10 further includes an inner handle 11, an inner escutcheon 12, and an inner fixing board 16. The inner fixing board 16 is mounted to engaging portion 546 of inner chassis 542. Inner escutcheon 12 is mounted around inner fixing board 16 to cover engaging portion 546 of inner chassis 542. Inner handle 11 includes a positioning groove 110. Inner handle 11 is mounted around second end 599 of inner spindle 595 with the end of inner engaging plate 615 extending through an end of inner spindle 595 into positioning groove 110 of inner handle 11. Thus, inner handle 11 can not move along the longitudinal axis to disengage from inner spindle 595. When inner handle 11 is rotated about the longitudinal axis, inner spindle 595 rotates together with inner handle 11 through inner engaging plate 615, forming an inner operational device 22 operated by inner handle 11.

Figure 8:
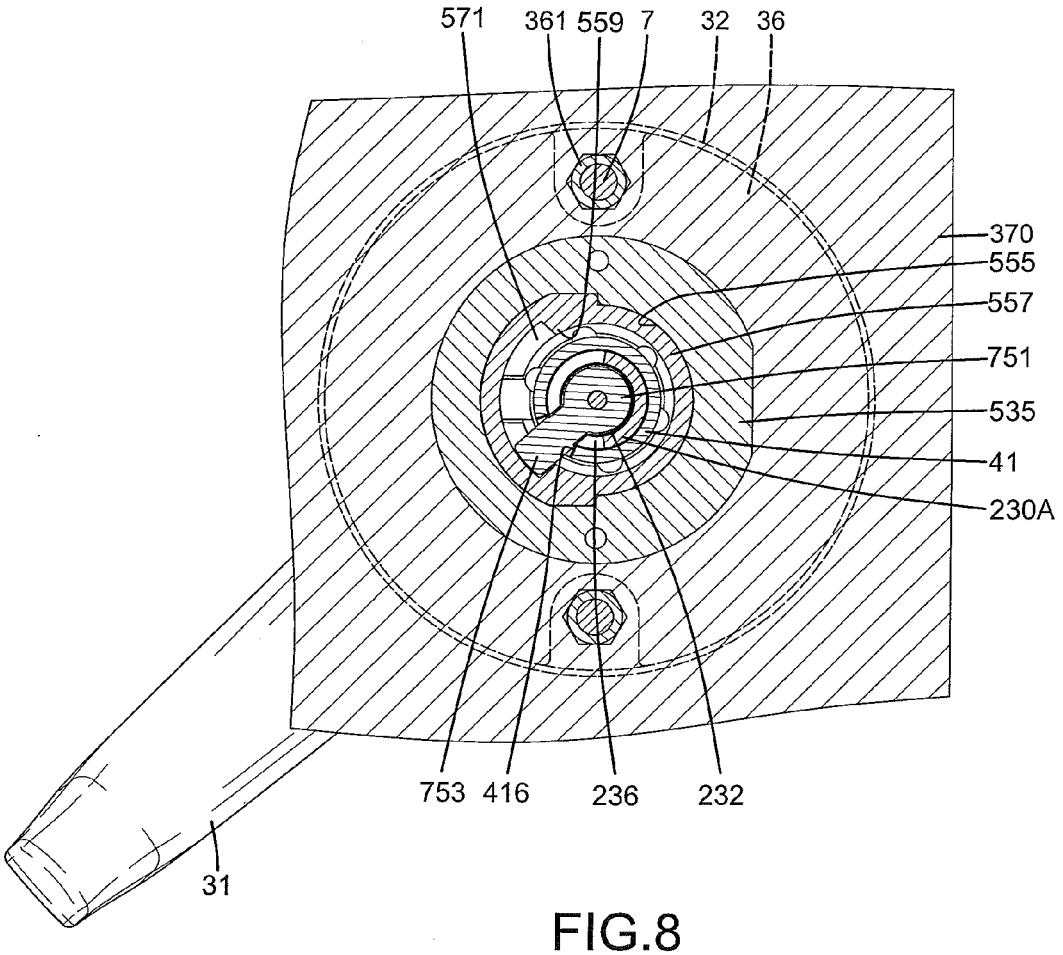
FIG. 8 is a view similar to FIG. 7 with an outer handle rotated through an angle.
Figure 9:
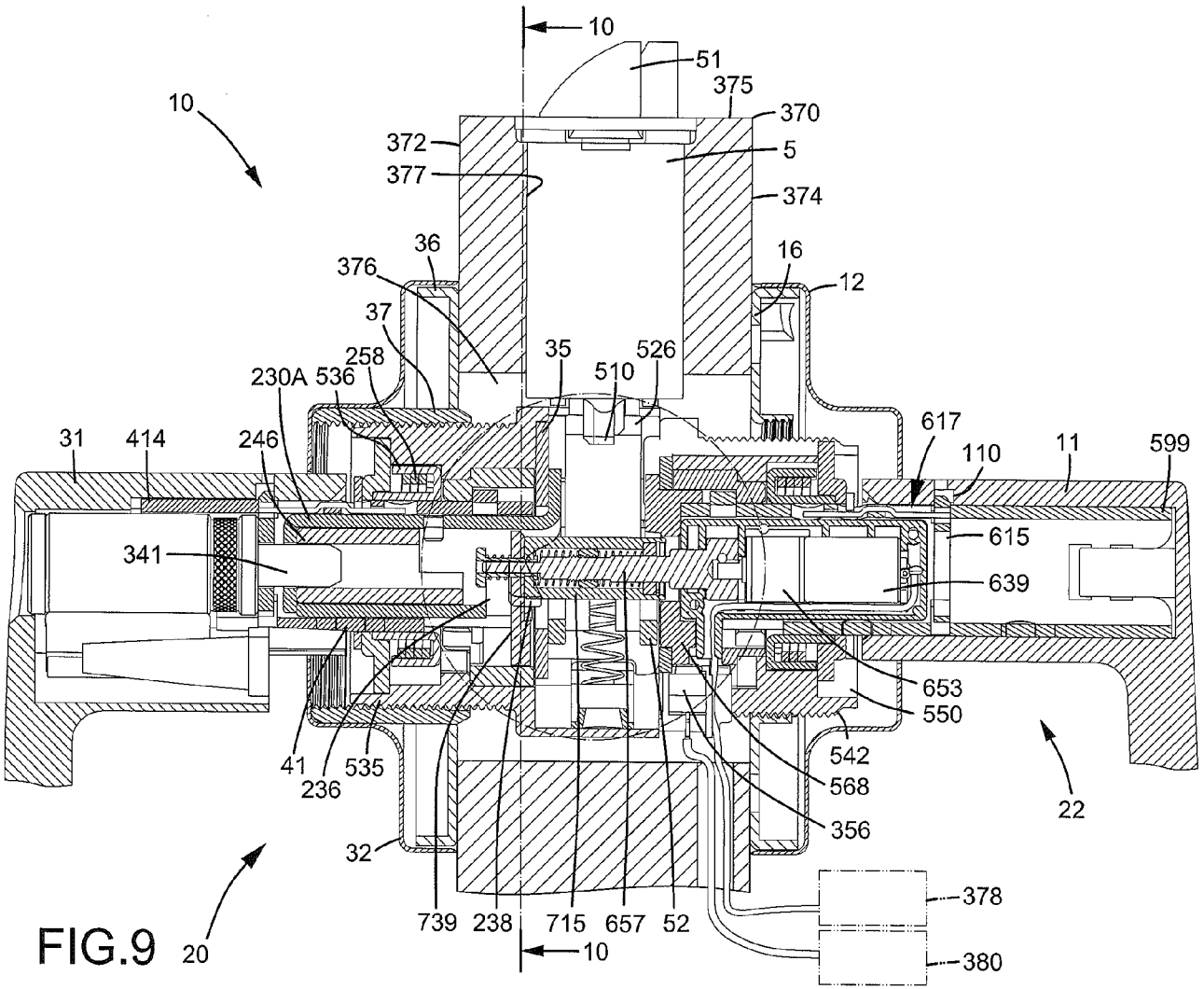
FIG. 9 is a view similar to FIG. 6 with a driving member moved by a sleeve after electricity is supplied to a motor.
Figure 9A:
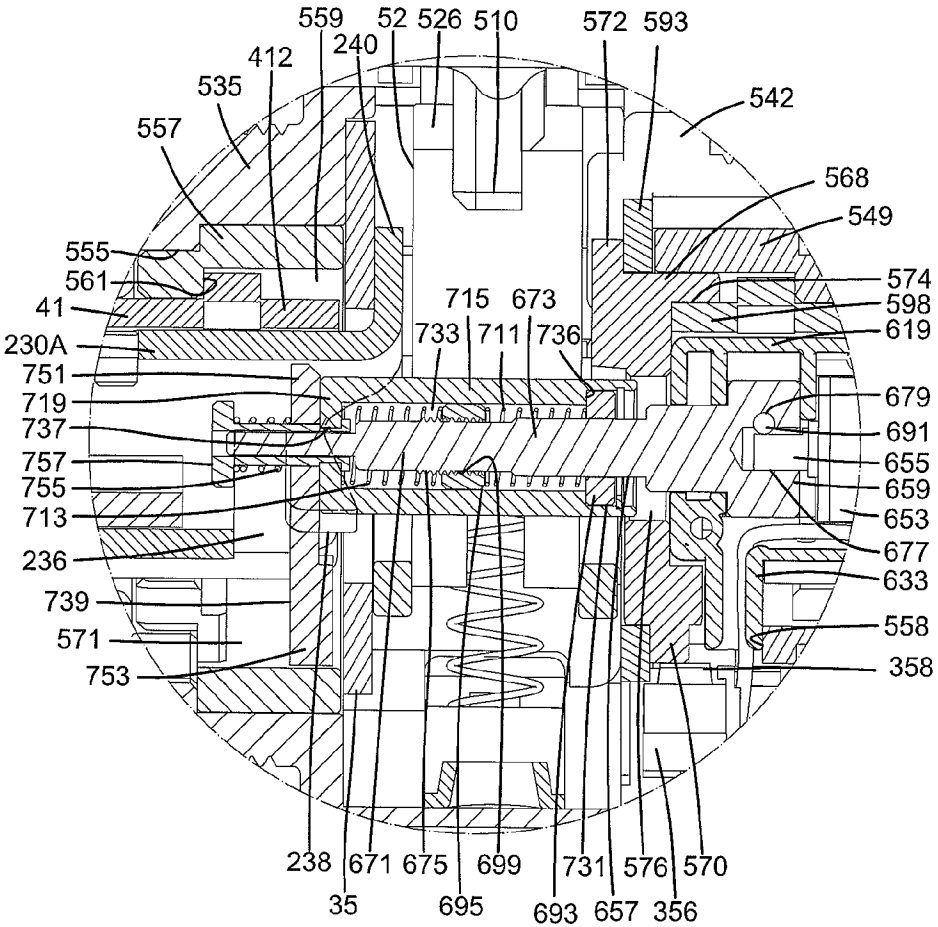
FIG. 9A is an enlarged view of a circled portion of FIG. 9.
Figure 10:
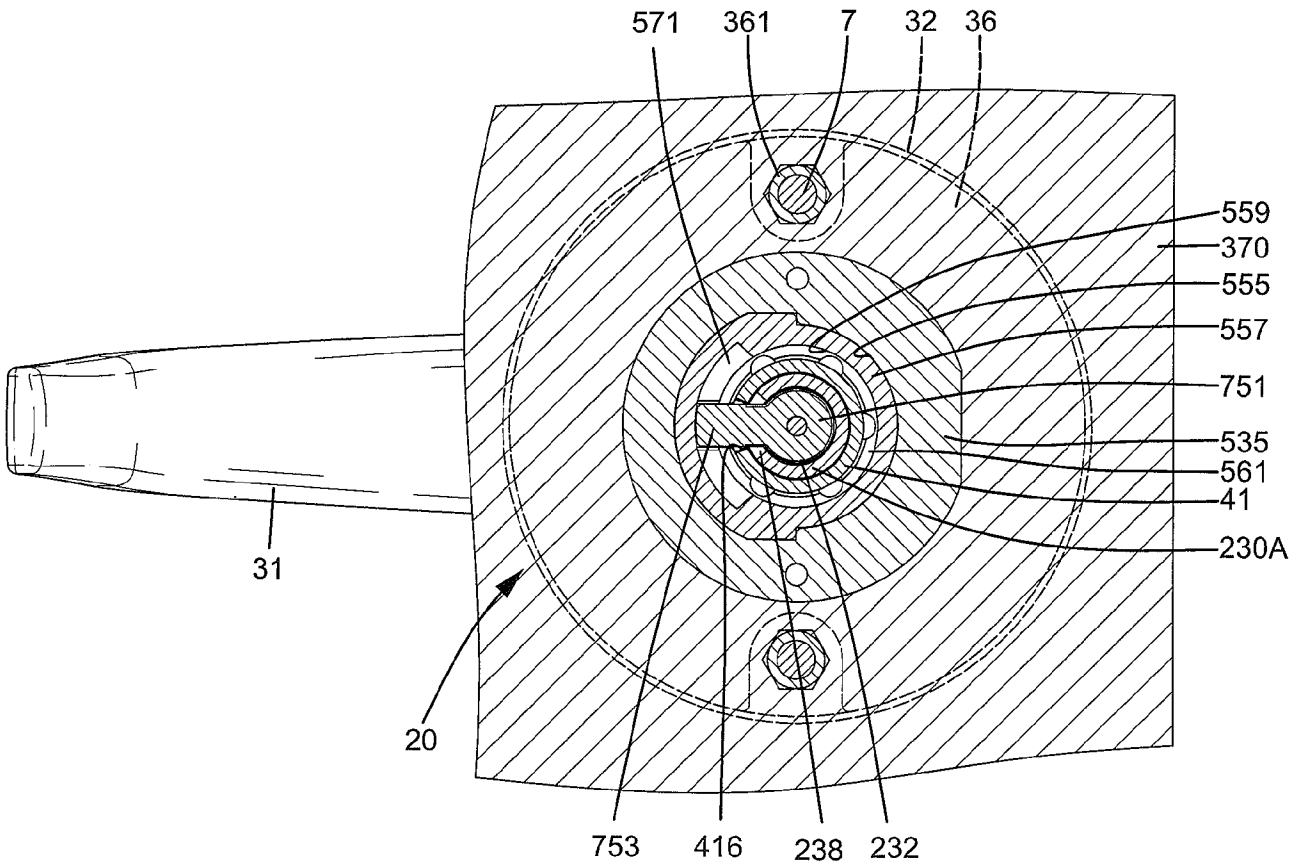
FIG. 10 is a cross sectional view taken along section line 10-10 in FIG. 9.

Flange 544 of inner chassis 542 abuts the end face of first portion 537 of outer chassis 535. Two screws 379 extend through flange 544 of inner chassis 542 into first portion 537 of outer chassis 535, fixing inner and outer chassis 542 and 535 together. Outer end 719 of sleeve 715, limiting member 757, third spring 755, and driving member 739 are located in space 232 of actuating member 230A. Furthermore, leg 753 of driving member 739 is located in limiting groove 234 of actuating member 230A, passageway 416 of outer spindle 41, and limiting groove 571 of lining sleeve 557. Thus, when outer spindle 41 pivots, the inner wall of passageway 416 of outer spindle 41 presses against and pivots leg 753 of driving member 739, and the limiting groove 571 of lining sleeve 557 limits the angular travel (about 60° in the form shown, see FIGS. 7 and 8) of outer spindle 41 by driving member 739. Furthermore, when coupling shaft 657 rotates, since outer spindle 41 limits rotation of driving member 739, the friction between pivotal portion 751 of driving member 739 and outer end 719 of sleeve 715 avoids sleeve 715 and push ring 695 from rotating jointly with coupling shaft 657. Thus, coupling shaft 657 pushes push ring 695 to move along the longitudinal axis by threaded section 675, causing movement of driving member 739 between a first position (FIG. 6) and a second position (FIG. 9). Furthermore, driving member 739 pivots when outer spindle 41 pivots.

Cylindrical lock 10 is adapted to be mounted to a door 370 having inner and outer faces 374 and 372 spaced along the longitudinal axis and a lateral face 375 extending between inner and outer faces 374 and 372. Door 370 further includes a mounting space 376 extending from outer face 372 through inner face 374. Door 370 further includes a transverse hole 377 extending from lateral face 375 to mounting space 376 in a direction perpendicular to the longitudinal axis. Inner chassis 542 and outer chassis 535 of cylindrical lock 10 are mounted in mounting space 376 of door 370. Second portion 539 of outer chassis 535 extends beyond mounting space 376 and is located at an outer side of door 370. Engaging portion 546 of inner chassis 542 extends beyond mounting space 376 and is located at an inner side of door 370. Inner fixing board 16 abuts inner face 374 of door 370. Inner handle 11 is located at the inner side of door 370.

According to the form shown, cylindrical lock 10 further includes an outer escutcheon 32, an outer fixing board 36, and a pressing ring 37. Two mounting posts 361 are mounted to outer fixing board 36. Outer fixing board 36 is mounted around second portion 539 of outer chassis 535 with mounting posts 361 extending through door 370. Two screws 7 extend through inner fixing board 16 into screw holes in mounting posts 361, fixing inner and outer fixing boards 16 and 36 to inner and outer faces 374 and 372 of door 370. Thus, inner chassis 542 and outer chassis 535 are fixed to door 370. Pressing ring 37 is threadedly engaged on second portion 539 of outer chassis 535 and presses against outer fixing board 36. Outer escutcheon 32 is mounted around outer fixing board 36. Pressing ring 37 and second portion 539 of outer chassis 535 are located inside outer escutcheon 32.

According to the form shown, cylindrical lock 10 further includes an outer handle 31 and a lock core 34. Outer handle 31 includes a positioning hole 311. Lock core 34 includes a tail piece 341 extending along the longitudinal axis. Lock core 34 is received in outer handle 31. Outer handle 31 is mounted around second end 414 of outer spindle 41 with the end of outer engaging plate 420 engaged in positioning hole 311 of outer handle 31. Thus, outer handle 31 can not disengage from outer spindle 41 along the longitudinal axis. When outer handle 31 rotates about the longitudinal axis, outer spindle 41 rotates jointly with outer handle 31. Tail piece 341 of lock core 34 extends through actuating member 230A and is connected to follower 246 to move therewith. When lock core 34 is rotated by a key, tail piece 341 drives and rotates jointly with follower 246 about the longitudinal axis. An outer operational device 20 operated by outer handle 31 is, thus, formed.

According to the form shown, cylindrical lock 10 further includes a latch device 5 having a latch bolt 51 movable between a latching position outside of door 370 and an unlatching position inside of door 370. Latch device 5 further includes an engagement portion 510 at an inner end thereof. Latch device 5 is mounted in transverse hole 377 of door 370 with latch bolt 51 located outside of lateral face 375 and with engagement portion 510 extending through notch 552 of outer chassis 535 and connected to connecting end 526 of retractor 52 to move therewith.

Figure 7:
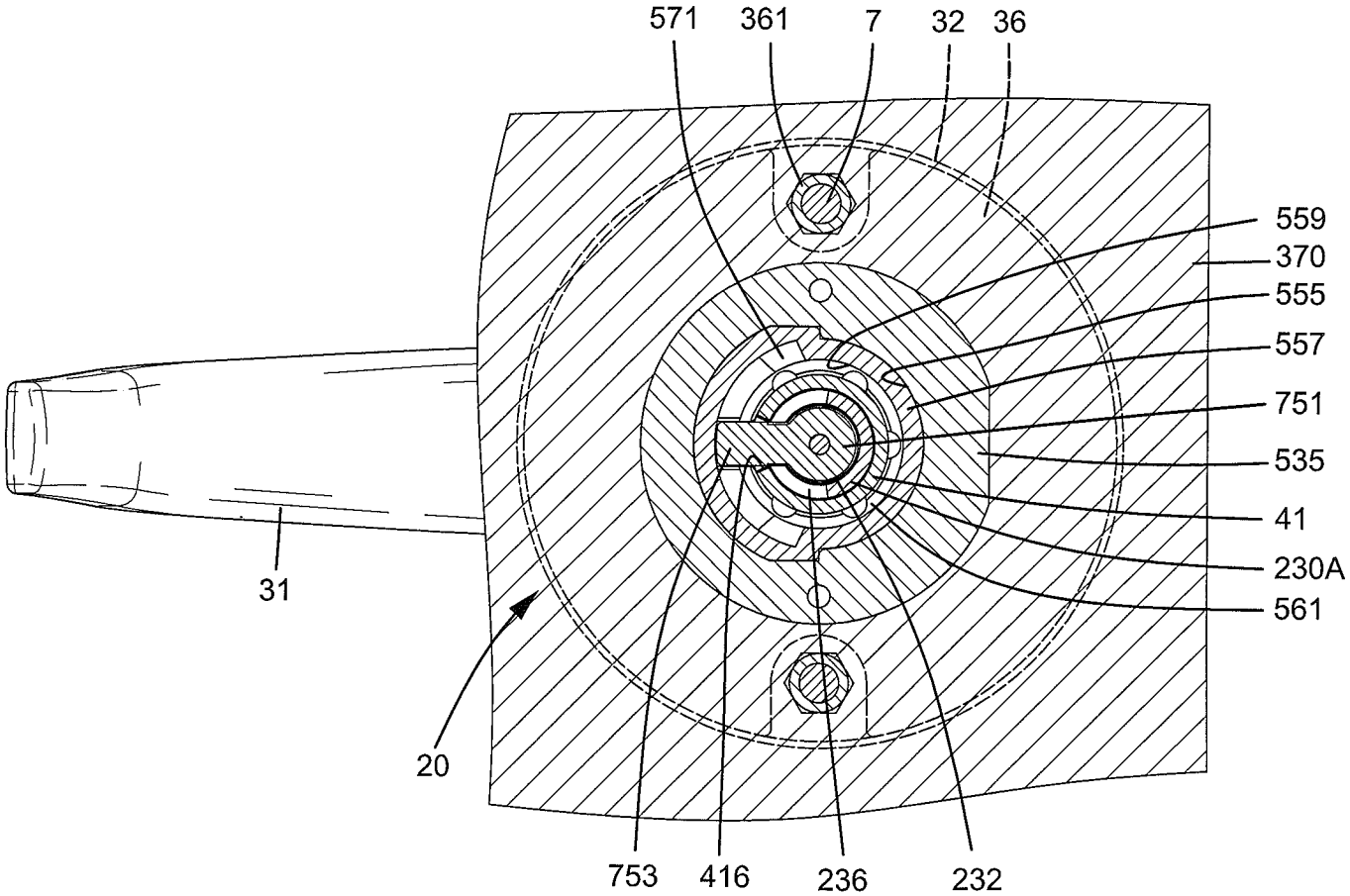
FIG. 7 is a cross sectional view taken along section line 7-7 in FIG. 1A.

Now that the basic construction of cylindrical lock 10 of the first embodiment of the present invention has been explained, the operation and some of the advantages of cylindrical lock 10 can be set forth and appreciated. In particular, for the sake of explanation, it will be assumed that door 370 is in a closed state, and cylindrical lock 10 is not operated (FIG. 6) with inner and outer handles 11 and 31 in horizontal positions (FIG. 7). Retractor 52 is in the third position with latch bolt 51 in the latching position. Driving member 739 is in the first position. Leg 753 of driving member 739 is received in larger groove section 236. Burglarproof system 380 is activated. Pressing block 570 of pressing member 568 presses against pressing plate 358 of detection member 356 (FIG. 7).

Since the arc of larger groove section 236 in the circumferential direction is larger than the rotatable angle (about 60° to the horizontal position) of outer handle 31 and outer spindle 41, driving member 739 can only rotate in larger groove section 236 without driving actuating member 230A when driving member 739 rotates. Since actuating member 230A is not rotated, retractor 52 is biased by springs 528 to be in the third position adjacent to notch 552 of outer chassis 535. Latch bolt 51 of latch device 5 remains in the latching position. In this state, rotation of outer handle 31 is free rotation without driving actuating member 230A. Furthermore, outer spring 258 is twisted when outer spindle 41 is rotated by outer handle 31, providing a returning function for outer handle 31 when outer handle 31 is released.

Figure 11:
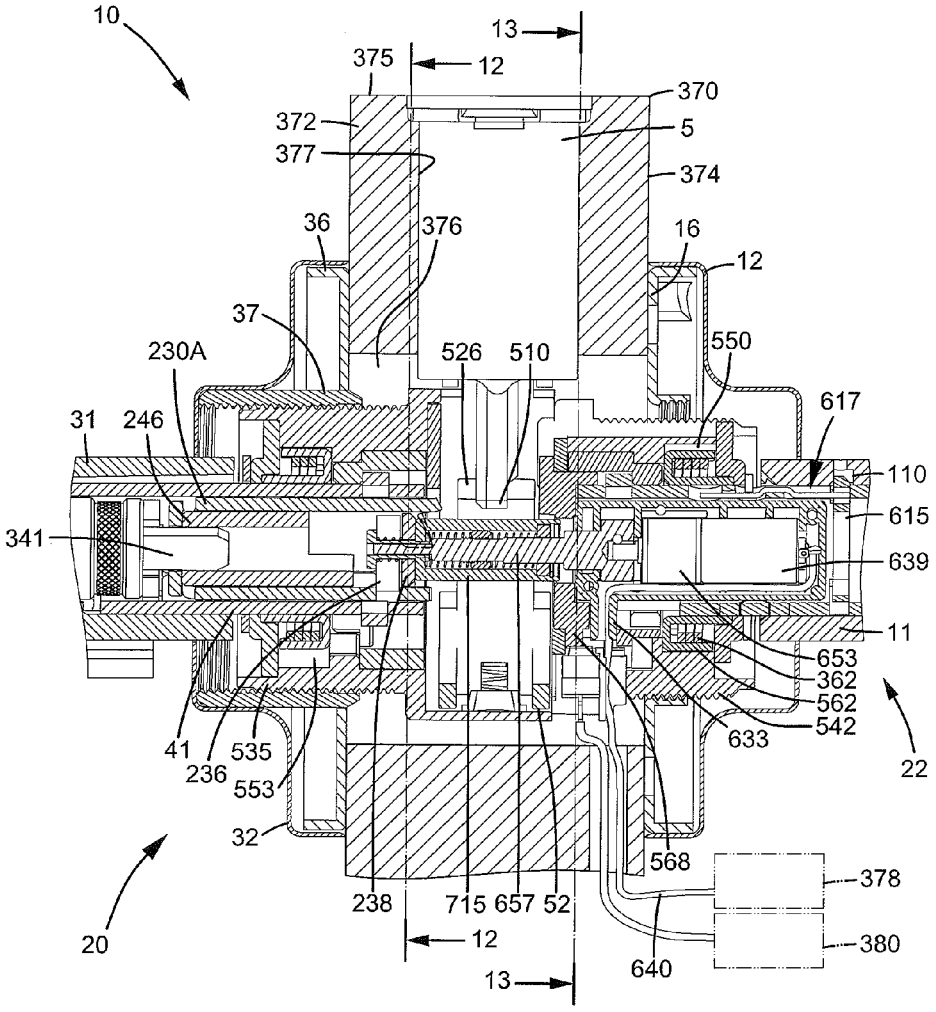
FIG. 11 is a view similar to FIG. 9 with the outer handle rotated.
Figure 12:
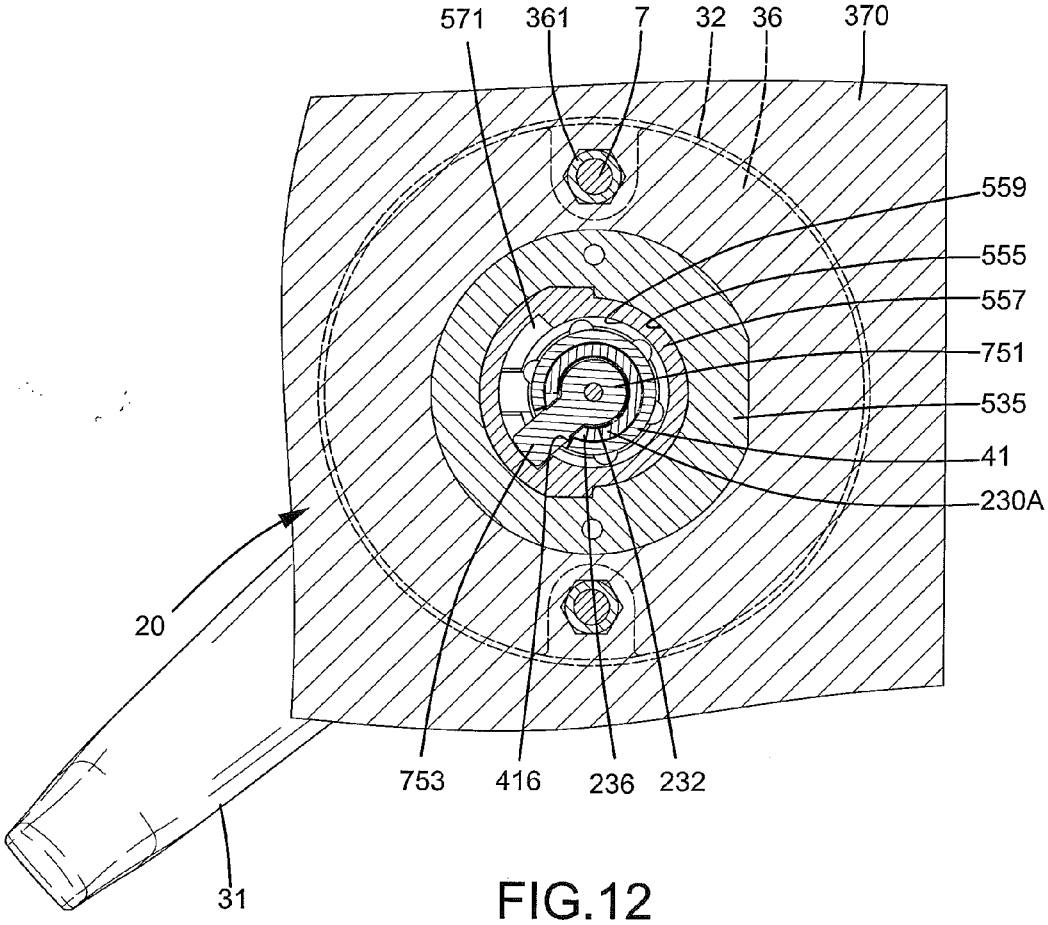
FIG. 12 is a cross sectional view taken along section line 12-12 in FIG. 11.

When locking driving device 617 is supplied with electricity by a power supply 378, motor 639 of locking driving device 617 drives coupling shaft 657 to rotate via speed reduction mechanism 653. Since shaft coupling section 674 of coupling shaft 657 is pivotably connected to axial hole 773 of limiting member 757 and is slideable along the longitudinal axis in axial hole 773 of limiting member 757, when the friction between sleeve 715 and driving member 739 avoids sleeve 715 and push ring 695 from rotating jointly with coupling shaft 657 while coupling shaft 657 rotates, rotation of threaded section 675 of coupling shaft 657 causes movement of push ring 695 towards inner chassis 542 along the longitudinal direction. Push ring 695 presses against sleeve 715 via second spring 713, moving sleeve 715 towards inner chassis 542 along the longitudinal axis. Since shaft coupling section 674 of coupling shaft 657 is pivotably connected to axial hole 773 of limiting member 757 and is slideable along the longitudinal axis in axial hole 773 of limiting member 757, driving member 739 is moved from the first position (FIG. 6 to the second position (FIG. 9). Leg 753 of driving member 739 is received in smaller groove section 238. In this state, when outer handle 31 is rotated about the longitudinal axis, outer spindle 41 rotates jointly with outer handle 31 due to provision of outer engaging plate 420. Leg 753 of driving member 739 is pushed by a lateral wall of passageway 416 so that driving member 739 rotates jointly with outer spindle 41. Leg 753 of driving member 739 presses against a peripheral wall of smaller groove section 238 such that actuating member 230A rotates jointly with driving member 739 about the longitudinal axis. Lug 240 of actuating member 230A presses against first actuation wall 522 of retractor 52 and, thus, moves refractor 52 from the third position (FIG. 6) to the fourth position (FIG. 11), and latch bolt 51 is moved to the unlatching position (FIG. 11). In this state, door 370 is unlatched and openable when outer handle 31 is rotated. Cylindrical lock 10 is assembled in a manner that cylindrical lock 10 is in an unlocking state after locking driving device 617 is supplied with electricity, and outer handle 31 can be operated to open door 370.

When driving member 739 is in the second position, motor 639 rotates in the reverse direction if electricity is supplied to locking driving device 617, and push ring 695 moves away from inner chassis 542 along the longitudinal axis. First spring 711 presses against an end face of bearing 693 to move sleeve 715 away from inner chassis 542 along the longitudinal axis, moving driving member 739 from the second position to the first position.

Figure 13:
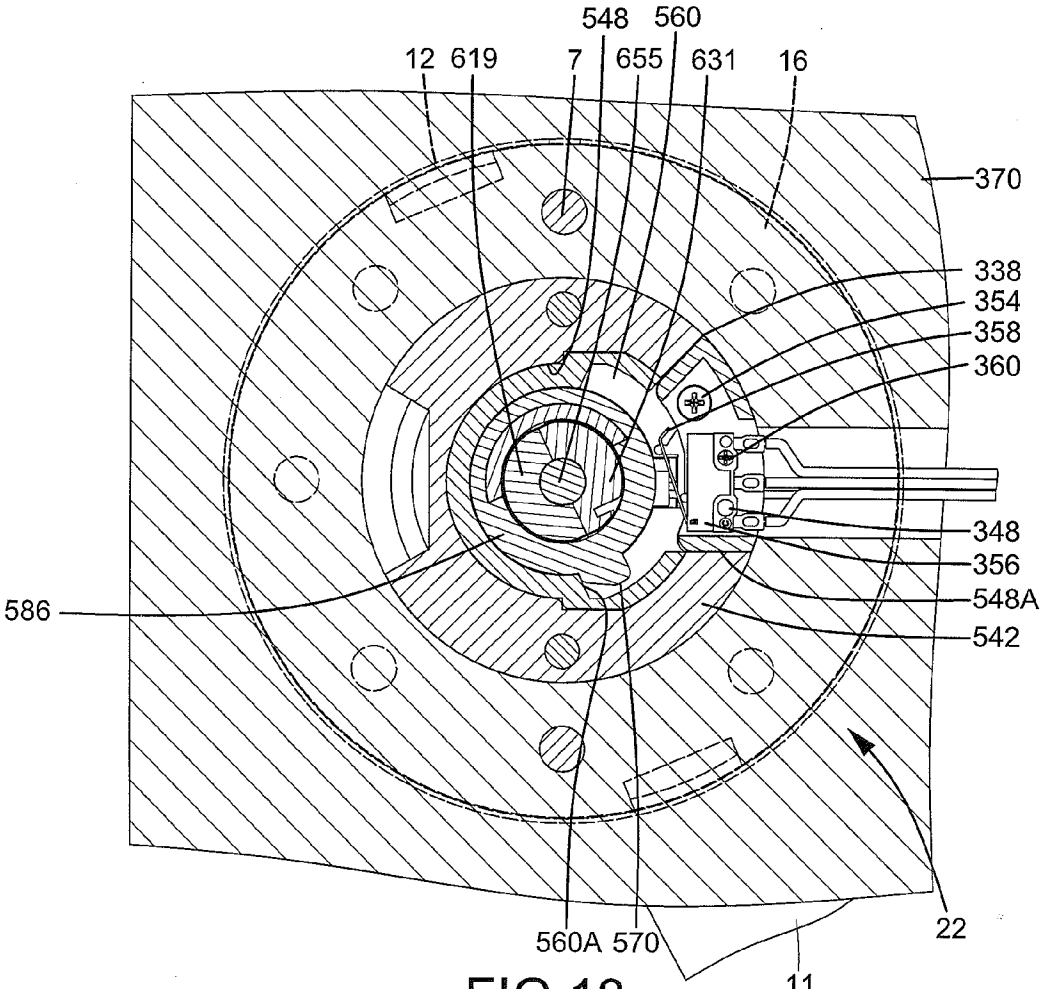
FIG. 13 is a cross sectional view taken along section line 12-12 in FIG. 11.

Furthermore, door 370 can be opened by rotating inner handle 11 of inner operational device 22 no matter driving member 739 is in the first or second position. Specifically, when inner handle 11 is rotated about the longitudinal axis, inner spindle 595 rotates jointly with inner handle 11 due to inner engaging plate 615. Engagement portion 598 of inner spindle 595 presses against the peripheral wall of engagement groove 574 of pressing member 568, causing joint rotation of pressing member 568 and inner spindle 595. Ear 572 of pressing member 568 pushes retractor 52 from the third position to the fourth position (FIG. 11) in the radial direction. First actuation wall 522 of retractor 52 is also moved away from lug 240. Connecting end 526 of retractor 52 actuates engagement portion 510 of latch device 5 and, thus, moves latch bolt 51 from the latching position to the unlatching position in the direction perpendicular to the longitudinal axis. At the same time, pressing block 570 of pressing member 568 disengages from pressing plate 358 of detection member 356 (FIG. 13). Furthermore, pressing block 570 of pressing member 568 abuts against restraining wall 560A of restraining groove 560 of lining sleeve 549 to restrain the rotational angle of inner handle 11. Further, pressing plate 358 of detection member 356 is stopped by restraining peg 352 of seat 338 such that returning of pressing member 568 will not be hindered by pressing plate 358. Further, inner spring 362 is twisted by actuating arm 564 when inner spindle 595 is rotated and drives inner follower ring 562, providing resiliency for returning inner handle 11 when inner handle 11 is released.

In cylindrical lock 10 according to the present invention, detection member 356 and pressing member 568 are mounted in inner operational device 22 such that burglarproof system 380 can detect whether cylindrical lock 10 is unlocked by inner operating device 22. Detecting member 356 and burglarproof system 380 can be arranged in differing ways according to different situations. As an example, when used in a large space such as a mall, customers can not access limited areas of the mall that are only for personnel. Thus, it is necessary to install a lock that can detect whether door 370 is opened by inner operational device 22. When burglarproof system 380 is activated and when door 370 is opened by operating inner operational device 22, burglarproof system 380 will generate an alarm to inform the personnel of intrusion in limited areas by an unauthorized person.

Figure 15:
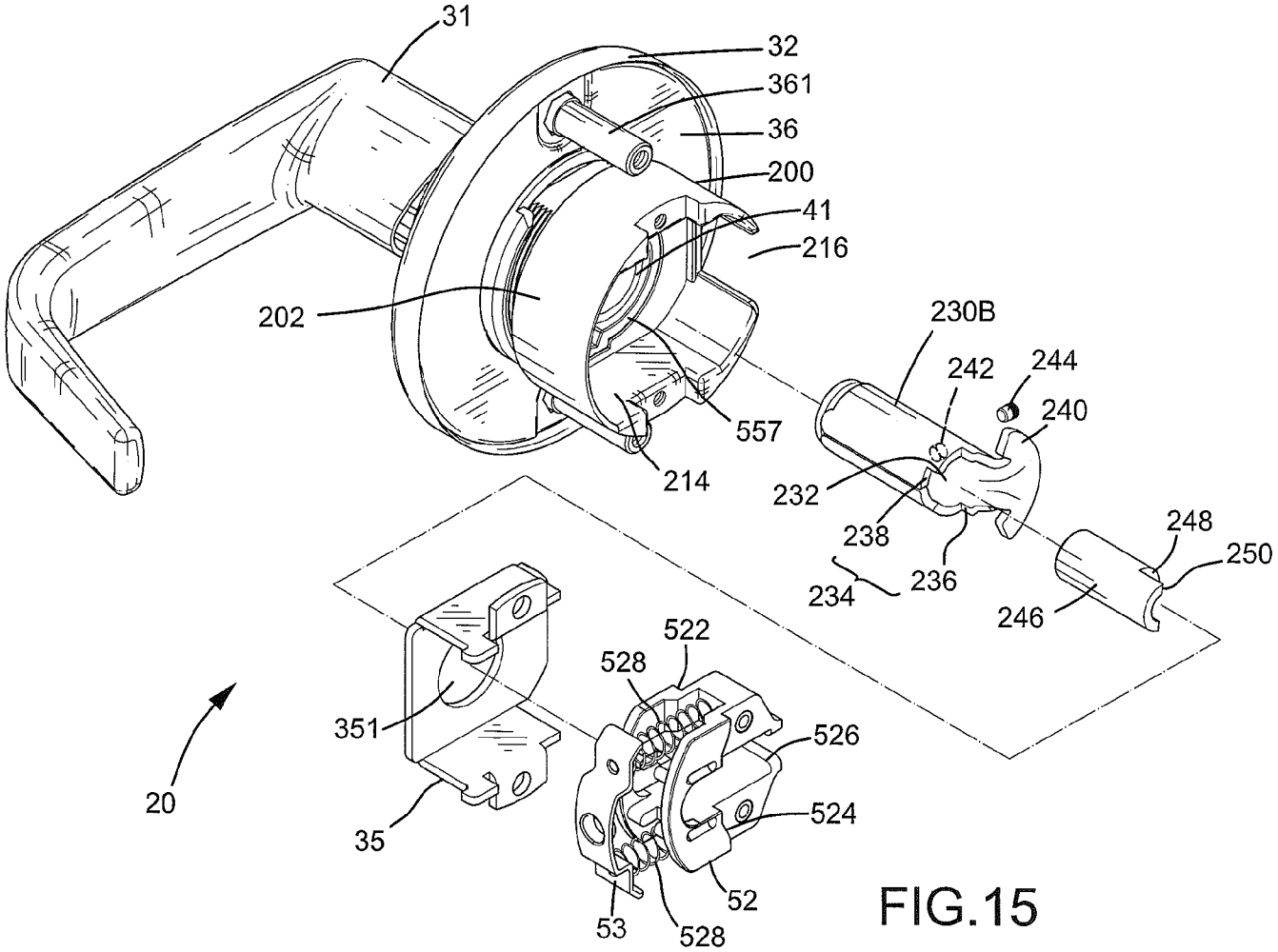
FIG. 15 is a partial, exploded, perspective view of an outer operational device of a cylindrical lock of a second embodiment according to the present invention.
Figure 16:
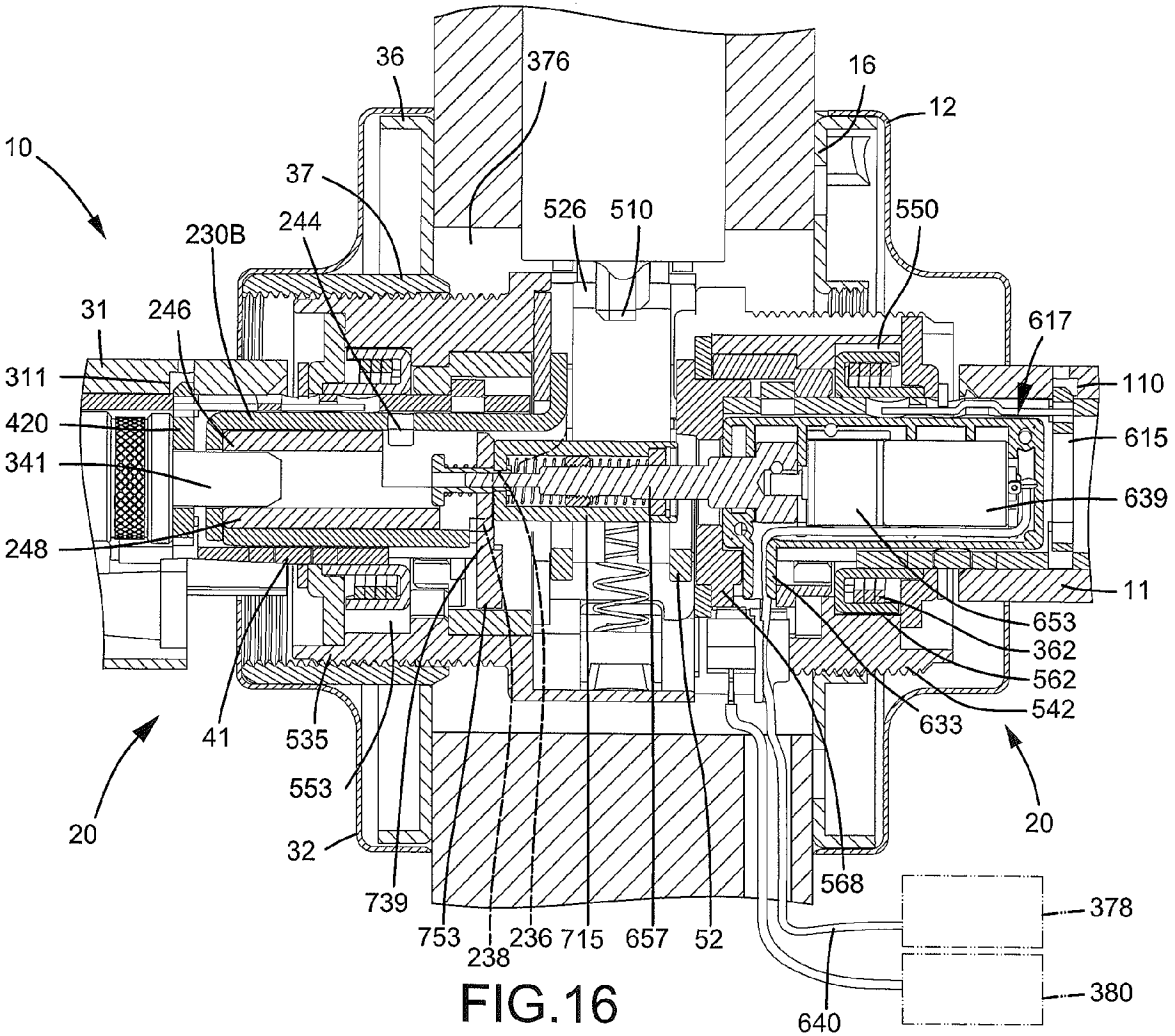
FIG. 16 is a cross sectional view of the cylindrical lock of FIG. 15.

FIGS. 15 and 16 show a second embodiment of cylindrical lock 10 according to the present invention. Specifically, cylindrical lock 10 of the second embodiment includes an actuating member 230B that is substantially the same as actuating member 230A except that the arc of larger groove section 236 of actuating member 230B extends to the end face of the first end and is located between smaller groove section 238 of actuating member 230B and lug 240. Specifically, the width of leg 753 is only slightly smaller than the arc of smaller groove section 238 of actuating member 230B in the circumferential direction. Furthermore, the width of leg 753 is smaller than the arc of larger groove section 236 of actuating member 230B in the circumferential direction. The arc of larger groove section 236 of actuating member 230B in the circumferential direction is preferably the same as the arc of larger groove section 236 of actuating member 230A. The arc of smaller groove section 238 of actuating member 230B in the circumferential direction is preferably the same as the arc of smaller groove section 238 of actuating member 230A.

Operation of cylindrical lock 10 of the second embodiment will now be set forth. In particular, for the sake of explanation, it will be assumed that door 370 is in a closed state, and cylindrical lock 10 is not operated (inner and outer handles 11 and 31 are in horizontal positions). Retractor 52 is in the third position with latch bolt 51 in the latching position. Driving member 739 is in the second position. Leg 753 of driving member 739 is received in smaller groove section 238 (FIG. 16).

Since the arc of the smaller groove section 238 of actuating member 230B is slightly larger than the width of leg 753 of driving member 739, rotation of outer handle 31 causes joint rotation of outer spindle 41 due to outer engaging plate 420. Driving member 739 rotates jointly with outer spindle 41 and pivots actuating member 230B, moving retractor 52 to the fourth position and moving latch bolt 51 to the unlatching position.

Figure 17:
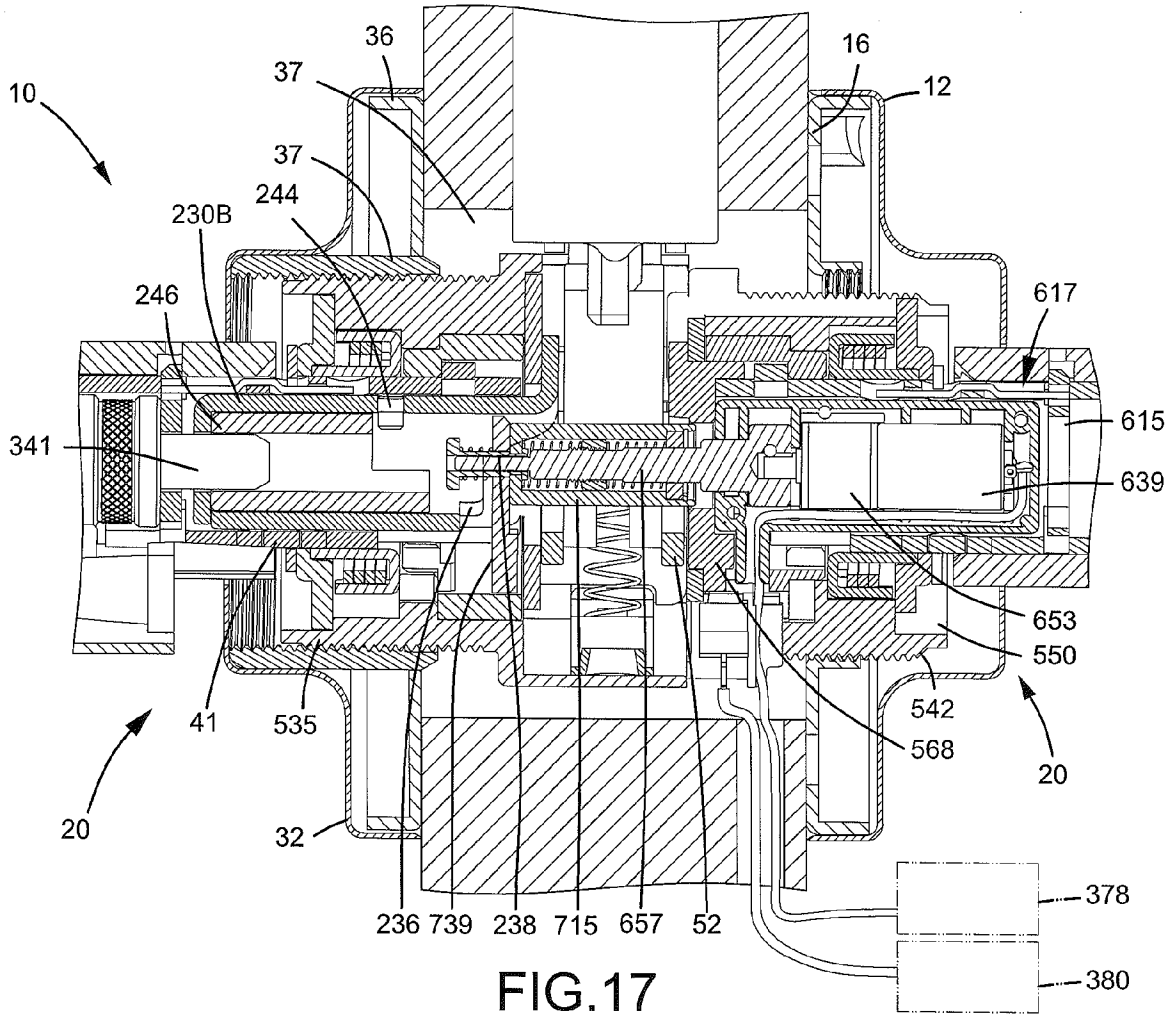
FIG. 17 is a view similar to FIG. 16 with a driving member moved by a sleeve after electricity is supplied to a motor.

When motor 639 of locking driving device 617 is supplied with electricity by power supply 378, motor 639 of locking driving device 617 drives coupling shaft 657 to rotate via transmission by speed reduction mechanism 653. Push ring 695 pushes sleeve 715 along the longitudinal axis towards inner chassis 542 via second spring 713. Thus, driving member 739 is moved from the first position (FIG. 16) to the second position (FIG. 17). Leg 753 of driving member 739 is received in larger groove section 236. In this state, when outer handle 31 is rotated about the longitudinal axis, since the arc of larger groove section 236 of actuating member 230B in the circumferential direction is larger than the rotatable angle (about 60° to the horizontal position) of outer handle 31 and outer spindle 41, driving member 739 can only rotate in larger groove section 236 without driving actuating member 230B when driving member 739 rotates. Since actuating member 230B is not rotated, retractor 52 is biased by springs 528 to be in the third position. Latch bolt 51 of latch device 5 remains in the latching position.

Operation of cylindrical lock 10 of the second embodiment by inner operational device 22 is identical to that of cylindrical lock 10 of the first embodiment.

It is noted that, in cylindrical locks 10 of the first and second embodiments shown in FIGS. 1-17, operation of outer handle 31 is free rotation when cylindrical lock 10 is in the locking state.

In either of the first and second embodiments, whether cylindrical lock 10 is in the locking or unlocking state, a key can be utilized to operate lock core 34 of outer operational device 20 to open door 370. Specifically, when the key is rotated, tail piece 341 of lock core 34 rotates to drive follower 246 to rotate. After abutment wall 250 of follower 246 abuts follower pin 244 of actuating member 230A or 230B, further rotation of lock core 34 drives actuating member 230A or 230B to rotate by pushing follower pin 244 through follower 246, moving retractor 52 from the third position to the fourth position and moving latch bolt 51 from the latching position to the unlatching position.

Figure 14:
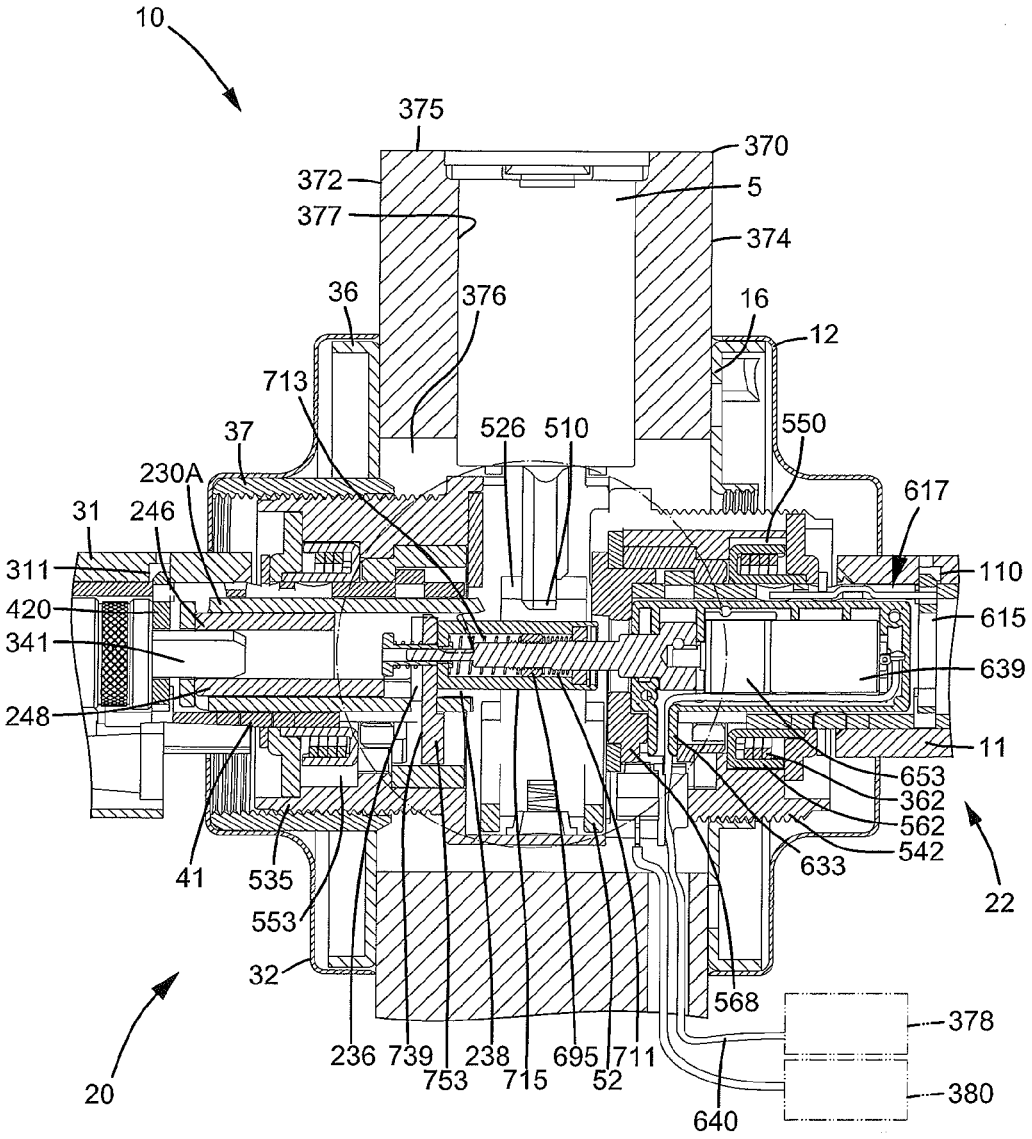
FIG. 14 is a view similar to FIG. 6 with an actuating member rotated through an angle by a key and with the driving member remained in a first position.
Figure 14A:
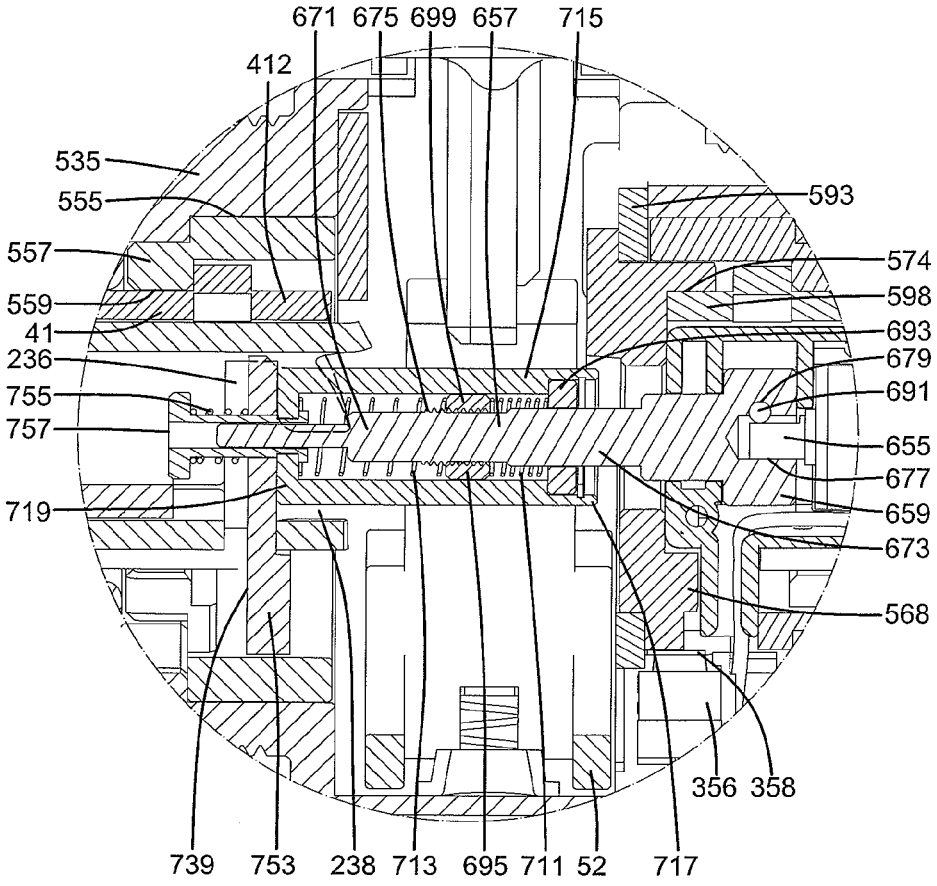
FIG. 14A is an enlarged view of a circled portion in FIG. 14.

In either of the first and second embodiments, locking driving device 617 includes a motor protection design to avoid motor 639 from getting stuck. Specifically, with reference to FIG. 14, in a case that a key is used to rotate lock core 34 or inner handle 11 of cylindrical lock 10 of the first embodiment is rotated to move latch bolt 51 to the latching position while a third person is proceeding with locking function setting of locking driving device 617 by way of remote operation, since leg 753 of driving member 739 is stopped by a wall of larger groove section 236 of actuating member 230A (i.e., driving member 739 is in the first position), movement of sleeve 715 along the longitudinal axis is restricted by driving member 739 such that sleeve 715 is not moved when coupling shaft 657 rotates; however, push ring 695 still moves along the longitudinal axis towards inner chassis 542 and compresses first spring 711 (see FIG. 14A).

Likewise, in a case that a key is used to rotate lock core 34 or inner handle 11 of cylindrical lock 10 of the second embodiment is rotated to actuate actuating member 230B to move latch bolt 51 to the latching position while a third person is proceeding with locking function setting of locking driving device 617 by way of remote operation, movement of driving member 739 towards outer chassis 535 along the longitudinal axis is restricted by the wall of larger groove section 236 of actuating member 230B such that sleeve 715 remains still while push ring 695 moves towards outer chassis 535 along the longitudinal axis and compresses second spring 713. Thus, motor 639 of locking driving device 617 will not get stuck by movement restriction of driving member 739 and sleeve 715 along the longitudinal axis.

Drives driving member 739 of cylindrical lock 10 is driven by motor 639 of locking driving device 617 to move for locking or unlocking function. In a case that electricity can not be supplied to motor 639, cylindrical lock 10 can maintain the locking function or unlocking function that has already been set. Specifically, if power failure occurs after cylindrical lock 10 has been set to be in a locking state, motor 639 will not drive driving member 739 to move, such that cylindrical lock 10 will not turn into the unlocking state. On the other hand, if power failure occurs after cylindrical lock 10 has been set to be in an unlocking state, motor 639 will not drive driving member 739 to move, such that cylindrical lock 10 will not turn into the locking state.

Furthermore, when sleeve 715 of locking driving device 617 is moved by first spring 711 or second spring 713, if driving member 739 and sleeve 715 get stuck and could not move, rotation of coupling shaft 657 can still move push ring 695 to compress and, thus, move first spring 711 or second spring 713, preventing motor 639 from getting stuck after electricity has been supplied. This reduces the possibility of damage to motor 639.

Furthermore, sleeve 715 is supported by bearing 693 and shaft coupling section 674 of coupling shaft 657 such that the longitudinal axis of sleeve 715 is coincident to the longitudinal axis of coupling shaft 657, assuring that threaded section 675 smoothly meshes with screw hole 699 of push ring 695 when coupling shaft 657 rotates, reliably pushing push ring 695 by coupling shaft 657.

Now that the basic teachings of the present invention have been explained, many extensions and variations will be obvious to one having ordinary skill in the art. For example, locking driving device 617 does not have to include third spring 755 and limiting member 757. In this case, driving member 739 is directly and pivotably mounted to an outer side of outer end 719 of sleeve 715, the outer periphery of sleeve 715 includes a longitudinal groove, and a pin is provided on the inner wall of space 232 of actuating member 230A, 230B and is inserted into the longitudinal groove. Thus, if actuating member 230A, 230B is not rotated, rotation of coupling shaft 657 can not cause joint rotation of push ring 695 and driving member 739 between the first position and the second position along the longitudinal axis. Furthermore, receptacle 733 of sleeve 715 does not have to include guiding grooves 735. Instead, longitudinal protrusions can be formed on the inner periphery of receptacle 733, and longitudinal grooves can be formed on the outer periphery of push ring 695 for receiving the longitudinal ribs for the purposes of preventing push ring 695 from rotating relative to sleeve 715. Furthermore, locking driving device 617 does not have to include first and second housings 619 and 631. In this case, motor 639 and speed reduction mechanism 653 can directly be mounted in receiving hole 611 of inner spindle 595. Although motor 639 and gear reduction mechanism 653 rotate jointly with inner spindle 595, the function of motor 639 and gear reduction mechanism 653 in moving driving member 739 between the first and second positions is not affected.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A cylindrical lock comprising:

an outer chassis including first and second portions spaced from each other along a longitudinal axis, with the outer chassis further including a first compartment in an end face of the first portion and an axial hole in communication with the first compartment of the outer chassis, and with the outer chassis adapted to be mounted in a mounting space of a door;

an outer spindle rotatably received in the axial hole of the outer chassis, with the outer spindle including first and second ends spaced from each other along the longitudinal axis, with a passageway extending from the first end of the outer spindle towards but spaced from the second end of the outer spindle along the longitudinal axis, with the first end of the outer spindle facing the first compartment of the outer chassis, and with the second end of the outer spindle located outside of the outer chassis;

an actuating member having first and second ends spaced from each other along the longitudinal axis, with the actuating member including a space extending from the first end of the actuating member towards but spaced from the second end of the actuating member along the longitudinal axis, with the actuating member further including a limiting groove extending from an end face of the first end of the actuating member towards but spaced from the second end of the actuating member along the longitudinal axis and in communication with the space of the actuating member, with the limiting groove of the actuating member including larger and smaller groove sections in communication with each other, with each of the larger and smaller groove sections of the actuating member extending in a circumferential direction about the longitudinal axis, with the actuating member further including a lug spaced from the limiting groove of the actuating member in a radial direction perpendicular to the longitudinal axis, with the actuating member rotatably received in the outer spindle, with the limiting groove of the actuating member aligned with the passageway of the outer spindle, and with the lug located outside of the outer spindle and received in the first compartment of the outer chassis;

an outer handle connected to the second end of the outer spindle, with the outer handle and the outer spindle jointly rotatable;

a retractor received in the first compartment of the outer chassis, with the retractor operatively coupled to the lug of the actuating member, with the retractor movable between third and fourth positions in a direction perpendicular to the longitudinal axis, and with a latch bolt operatively connected to the retractor and movable between a latching position outside of the door and an unlatching position inside the door;

an inner chassis engaged with the outer chassis and facing the first compartment, with the inner chassis including an axial hole, and with the inner chassis adapted to be mounted in the mounting space of the door;

an inner spindle rotatably received in the axial hole of the inner chassis, with the inner spindle including first and second ends spaced from each other along the longitudinal axis, with the inner spindle further including a receiving hole extending from the first end of the inner spindle through the second end of the inner spindle, with an engagement portion extending from the first end of the inner spindle away from the second end of the inner spindle along the longitudinal axis, and with the second end of the inner spindle located outside of the inner chassis;

a pressing member engaged with the engagement portion of the inner spindle, with the pressing member and the inner spindle jointly rotatable, and with the pressing member further including an ear operably connected to the retractor;

a motor received in the receiving hole of the inner spindle;

a gear reduction mechanism mounted in the receiving hole of the inner spindle and connected to the motor, with the gear reduction mechanism including a driving shaft driven by the motor;

a coupling shaft including a connection end coupled to the driving shaft and a driving end spaced from the connection end along the longitudinal axis, with the coupling shaft further including an intermediate section between the connection end and the driving end, and with the driving end including a threaded section formed on an outer periphery thereof;

a push ring having non-circular cross sections, with the push ring including a screw hole in threading connection with the threaded section of the coupling shaft, and with the push ring moving along the longitudinal axis when the coupling shaft rotates;

a sleeve mounted around the push ring and the driving end of the coupling shaft, with the sleeve not jointly rotatable with the coupling shaft, with the sleeve including an inner end and an outer end spaced from the inner end along the longitudinal axis, with the sleeve further including a recessed portion extending from the inner end towards but spaced from the outer end of the sleeve, with a receptacle extending from a bottom wall of the recessed portion towards but spaced from the outer end of the sleeve, with the receptacle having non-circular cross sections, with the push ring non-rotatably received in the receptacle but slideable in the receptacle along the longitudinal axis, and with the outer end of the sleeve extending into the space of the actuating member;

a bearing mounted in the recessed portion of the sleeve and pivotably coupled to the intermediate section;

a first spring received in the receptacle of the sleeve, mounted between the sleeve and the coupling shaft in a radial direction perpendicular to the longitudinal axis, and located between the push ring and the bearing along the longitudinal axis;

a second spring identical to the first spring, with the second spring received in the receptacle of the sleeve, mounted between the sleeve and the coupling shaft in the radial direction perpendicular to the longitudinal axis, and located between the push ring and a bottom wall of the receptacle along the longitudinal axis;

a driving member pivotably mounted to the outer end of the sleeve, with the driving member including a leg received in the limiting groove of the actuating member and the passageway of the outer spindle, with the driving member and the sleeve jointly moveable along the longitudinal axis, and with the leg of the driving member driven by and rotating together with the outer spindle when the outer spindle rotates;

an inner handle connected to the second end of the inner spindle, wherein when the inner handle is rotated, the inner spindle and the pressing member rotate jointly, and the latch bolt is moved from the latching position to the unlatching position, wherein when the driving member is in the first position, the leg of the driving member is located in the larger groove section of the actuating member, wherein when the driving member is in the second position, the leg of the driving member is located in the smaller groove section of the actuating member, wherein when the driving member is in the first position and if the coupling shaft rotates in a first direction, the push ring is moved to push one of the first and second springs along the longitudinal axis to move the sleeve, which, in turn, moves the driving member from the first position to the second position along the longitudinal axis, wherein when the driving member is in the second position and if the coupling shaft rotates in a second direction reverse to the first direction, the push ring pushes another of the first and second springs along the longitudinal axis to move the sleeve, which, in turn, moves the driving member from the second position to the first position, wherein when the driving member is in the first position and if the outer handle is rotated to pivot the driving member , the leg of the driving member pivots in the larger groove section of the actuating member, and the actuating member and the latch bolt are not moved, and wherein when the driving member is in the second position and if the outer handle is rotated, the driving member and the actuating member are driven to rotate jointly, and the latch bolt moves from latching position to the unlatching position.

2. The cylindrical lock as claimed in claim 1, with the sleeve further including a guiding groove formed in an inner periphery of the receptacle and extending from the bottom wall of the recessed portion to the bottom wall of the receptacle along the longitudinal axis, with the push ring further including a protrusion on an outer periphery thereof, with the protrusion slideably received in the guiding groove, and with the push ring slideable relative to the sleeve along the longitudinal axis but not rotatable relative to the sleeve.

3. The cylindrical lock as claimed in claim 1, further comprising:

a limiting member fixed to the outer end of the sleeve, with the limiting member including a shank and a head having an outer diameter larger than a diameter of the shank, with the shank including a distal end extending through the driving member and fixed to the outer end of the sleeve; and a third spring mounted around the shank of the limiting member and located between the driving member and the head of the limiting member, with the third spring biasing the driving member to press against the outer end of the sleeve, creating a friction force between the driving member and the sleeve, with the friction force larger than a torque applied to the sleeve by the push ring during rotation of the coupling shaft, preventing the sleeve and the push ring from rotating jointly with the coupling shaft.

4. The cylindrical lock as claimed in claim 3, with the limiting member further including an axial hole in an end face of the shank, with a shaft coupling section extending from an end face of the driving end of the coupling shaft, with the shaft coupling section rotatably received in the axial hole of the limiting member and slideable in the axial hole of the limiting member along the longitudinal axis, allowing the driving member and the limiting member to move jointly between the first and second positions along the longitudinal axis.

* * * * *